US008801462B2

(12) United States Patent
Tsai

(10) Patent No.: US 8,801,462 B2
(45) Date of Patent: Aug. 12, 2014

(54) ELECTRICAL SOCKET

(76) Inventor: Chou Hsien Tsai, SinJhuang (TW)

( * ) Notice: Subject to any disclaimer, the term of this patent is extended or adjusted under 35 U.S.C. 154(b) by 263 days.

(21) Appl. No.: 13/481,710

(22) Filed: May 25, 2012

(65) Prior Publication Data

US 2012/0302076 A1 Nov. 29, 2012

(30) Foreign Application Priority Data

May 27, 2011 (TW) ..... 100209677 U
Sep. 15, 2011 (TW) ..... 100217311 U
Jan. 13, 2012 (TW) ..... 101200911 U

(51) Int. Cl.
*H01R 13/648* (2006.01)

(52) U.S. Cl.
USPC ..... 439/607.01; 439/660

(58) Field of Classification Search
CPC ..... H01R 23/7073; H01R 12/724; H01R 13/6658; H01R 12/721; H01R 13/6582; H01R 12/58; H01R 13/6587
USPC ..... 439/607.1
See application file for complete search history.

(56) References Cited

U.S. PATENT DOCUMENTS

| | | | | |
|---|---|---|---|---|
| 7,534,141 | B1 * | 5/2009 | Wu | 439/607.01 |
| 7,862,346 | B1 * | 1/2011 | Wan et al. | 439/79 |
| 8,079,854 | B2 * | 12/2011 | He et al. | 439/108 |
| 2009/0117784 | A1 * | 5/2009 | Wu | 439/660 |
| 2009/0311907 | A1 * | 12/2009 | Li | 439/607.01 |
| 2010/0136806 | A1 * | 6/2010 | Chen et al. | 439/79 |
| 2010/0136848 | A1 * | 6/2010 | Lin et al. | 439/701 |

* cited by examiner

*Primary Examiner* — Truc Nguyen
(74) *Attorney, Agent, or Firm* — Pro-Techtor Int'l Services

(57) ABSTRACT

An electrical socket includes a plastic seat having a connection surface, a connection slot disposed in the plastic seat and rows of first and second terminals disposed on the plastic seat. A plug may be inserted into the connection slot, in which the connection surface facing an insert-connection surface of the plug is disposed. The plastic seat has rows of first and second terminal slots. A front section of the second terminal slot has an opening communicating with the connection slot. The first and second terminals are assembled into the first and second terminal slots, respectively. Fixing portions of the first and second terminals are fixed to the first and second terminal slots, respectively. A front section of an extension of the second terminal rests against a resting surface of the second terminal slot. The second contact is exposed to the connection slot through the opening.

25 Claims, 26 Drawing Sheets

68
80
70
533
530
82
83
81
80
88
84
86
87
72
73
71
70
74
75
531
530
532
533
51
50
58
520
530
526
525
520
523
527
524
521
522
58

520
530
80
54
60
87
70
530
81
813
61
88
52
55
86
84

533
530
63
80
58
83
73
520
60
534
524
530
70
61
53
521
74
61
62
52
66
65
522
51

64
63
67
60
69
62
65
652
66
651

ELECTRICAL SOCKET

BACKGROUND OF THE INVENTION

1. Field of the Invention

The invention relates to an electrical connector, and more particularly to an electrical socket.

2. Related Art

At present, the most popular signal transmission specification for the computer apparatus is the universal serial bus (USB). A connector socket and a transmission cable manufactured according to this specification can be immediately used to connect a peripheral apparatus, such as a mouse, a keyboard or the like, to the computer in a plug-and-play manner.

At present, the USB specifications contain USB 2.0 and USB 3.0 specifications. Referring to FIGS. 1 to 3, a conventional USB 3.0 socket includes a plastic seat 30, a metal casing 40, one row of first terminals 10 and one row of second terminals 20.

The plastic seat 30 has one row of terminal slots 31. The front end of the plastic seat 30 is projectingly formed with a tongue 35. The tongue 35 extends horizontally.

The metal casing 40 is fixed to the plastic seat 30 and has a connection slot 41, which is disposed on the front end of the plastic seat 30 and covers the tongue 35.

The one row of first terminals 10 contain four first terminals 10, which are numbered as 1 to 4, as shown in FIG. 3. The first terminal 10 has, from front to rear, an elastic arm 11, a fixing portion 12 and a pin 13. The fixing portion 12 is positioned in the terminal slot 31 inside the plastic seat 30. The elastic arm 11 extends toward the connection slot 51 and has a projecting first connection contact 14 projecting beyond the bottom surface of the tongue 35. The pin 13 is connected to the rear end of the fixing portion 12.

The one row of second terminals 20 contain five second terminals 20, which are numbered as 5 to 9, as shown in FIG. 3. The second terminal 20 has, from front to rear, a second connection contact 21, an extension 22, a fixing portion 23 and a pin 24. The second connection contact 21 is in flat surface contact with the front section of the tongue 35 and disposed in front of the first connection contact 14. The extension 22 extends frontwards from the rear section of the tongue 35 and is connected to the second connection contact 21 and disposed between two elastic arms 11 of the first terminals 10. The fixing portion 23 is positioned in the terminal slot 31 of the plastic seat 30, and the pin 24 is connected to the rear end of the fixing portion 23.

The one row of first terminals 10 and the one row of second terminals 20 are formed by pressing the same metal sheet. After pressing, the two rows of terminals are connected to a material tape 18.

The one row of first terminals 10 do not overlap with the one row of second terminals 20 in the top viewing direction. So, when the one row of first terminals 10 are elastically moved vertically, they cannot touch the one row of second terminals 20 to cause the short-circuited condition.

However, the conventional design has the following drawbacks. Since the one row of first terminals 10 cannot overlap with the one row of second terminals 20 in the top viewing direction, the plate surface widths of the first terminal 10 and the second terminal 20 have to be reduced to avoid the overlap. Thus, the preferred widths of the first terminal 10 and the second terminal 20 cannot be freely configured to achieve the better electrical transmission requirement, and the high-speed electrical transmission requirement of the advanced electronic product cannot be satisfied.

As shown in FIG. 4 illustrating another conventional USB 3.0 socket, in order to freely configure the preferred widths of the first terminal 10 and the second terminal 20, the one row of first terminals 10 inevitably overlap with the one row of second terminals 20 in the top viewing direction. In order to prevent the one row of first terminals 10 from touching the one row of second terminals 20 to cause the short-circuited condition when they are elastically moved vertically, the vertical turning portion has to be formed between the second connection contact 21 and the extension 22 of the second terminal 20 to form a height difference. Thus, the height difference of the second terminal 20 caused by the turning portion also affects the electrical transmission, and the height difference of the turning portion also make it difficult to assemble the one row of second terminals 20 with the tongue 35 of the plastic seat, and the manufacturing method of embedded injection has to be adopted, thereby increasing the manufacturing cost.

SUMMARY OF THE INVENTION

A main object of the invention is to provide an electrical socket capable of achieving the better electrical transmission and simplifying the manufacturing processes.

Another main object of the invention is to provide an electrical socket, wherein two rows of terminal slots are assembled with the plastic seat to simplify the manufacturing processes.

Still another main object of the invention is to provide an electrical socket capable of achieving the goal of disposing multiple layers of USB 3.0 sockets simply.

To achieve the above-identified objects, the invention provides an electrical socket including a plastic seat having a connection surface, a connection slot disposed in the plastic seat, one row of first terminals disposed on the plastic seat and one row of second terminals disposed on the plastic seat. The connection surface is disposed in the connection slot, a plug may be inserted into the connection slot, the connection surface faces an insert-connection surface of the plug, and at least one row of connection contacts are disposed on the insert-connection surface of the plug. The first terminal has an extension, a fixing portion and a pin, wherein the extension is connected to a front end of the fixing portion, extends frontwards and has a first contact, the first contact can be elastically moved vertically and projects beyond the connection surface, and the pin is connected to a rear end of the fixing portion and extends out of the plastic seat. The second terminal has a second contact, an extension, a fixing portion and a pin, wherein the extension is connected to a front end of the fixing portion and extends frontwards, the second contact is connected to a front end of the extension, the pin is connected to a rear end of the fixing portion and extends out of the plastic seat, and the second contact is disposed in front of the first contact. The plastic seat has one row of first terminal slots and one row of second terminal slots. The one row of first terminal slots are closer to the connection surface than the one row of second terminal slots. One surface of the second terminal slot close to the connection surface is a resting surface. A front section of the second terminal slot has an opening communicating with the connection slot. The one row of first terminals are assembled into the one row of first terminal slots. The fixing portion of the first terminal is fixed to the first terminal slot. The one row of second terminals are assembled into the one row of second terminal slots. The fixing portion of the second terminal is fixed to the second terminal slot. A front section of the extension of the second terminal rests against the resting surface. The second contact is exposed to the connection slot through the opening.

The invention further provides an electrical socket including a plastic seat having a main frame and tongue board members, connection slots correspondingly disposed in front of chambers of the plastic seat, multiple rows of first terminals disposed on the tongue board members, respectively, and multiple rows of second terminals disposed on the tongue board members, respectively. The at least one divider is disposed in the main frame to divide the plastic seat into the vertically arranged chambers. Each of the tongue board members has a tongue and a mounting seat. The tongue has a connection surface, and the mounting seat of each of the tongue board members is assembled and fixed to one of the chambers. The tongue of each of the tongue board members is disposed in one of the connection slots. A plug may be inserted into each of the connection slots. Insert-connection surfaces of the connection surface and the plug face each other, and at least one row of connection contacts are disposed on an insert-connection surface of the plug. The first terminal has an extension, a fixing portion and a pin, wherein the extension is connected to a front end of the fixing portion, extends frontwards and has a first contact, the first contact can be elastically moved vertically and projects beyond the connection surface, and the pin is connected to a rear end of the fixing portion and extends out of the plastic seat. The second terminal has a second contact, an extension, a fixing portion and a pin, wherein the extension is connected to a front end of the fixing portion and extends frontwards, the second contact is connected to a front end of the extension, the pin is connected to a rear end of the fixing portion and extends out of the plastic seat, and the second contact is disposed in front of the first contact. The tongue board member is integrally formed with one row of first terminal slots and one row of second terminal slots. The one row of first terminal slots are closer to the connection surface than the one row of second terminal slots. One surface of the second terminal slot close to the connection surface is a resting surface. A front section of the second terminal slot is formed with an opening communicating with the connection slot. One of the rows of first terminals are assembled into the one row of first terminal slots. The fixing portion of the first terminal is fixed to the first terminal slot. One of the rows of second terminals are assembled into the one row of second terminal slots. The fixing portion of the second terminal is fixed to the second terminal slot. A front section of the extension of the second terminal rests against the resting surface, and the second contact is exposed to the connection slot through the opening.

Further scope of the applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

DETAILED DESCRIPTION OF THE INVENTION

Figure 3:
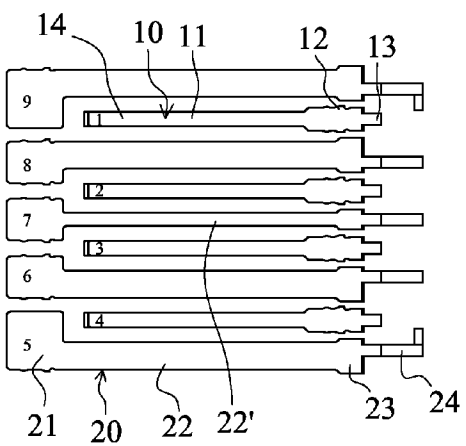
FIG. 3 (Prior Art)
FIG. 3 is a top-side view showing two rows of terminals of the conventional USB 3.0 socket.
Figure 4:
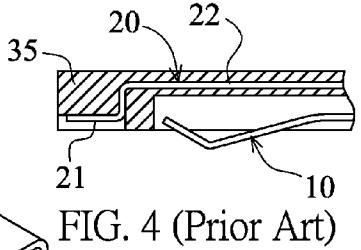
FIG. 4 (Prior Art)
FIG. 4 is a cross-sectional side view showing the conventional USB 3.0 socket.
Figure 1:
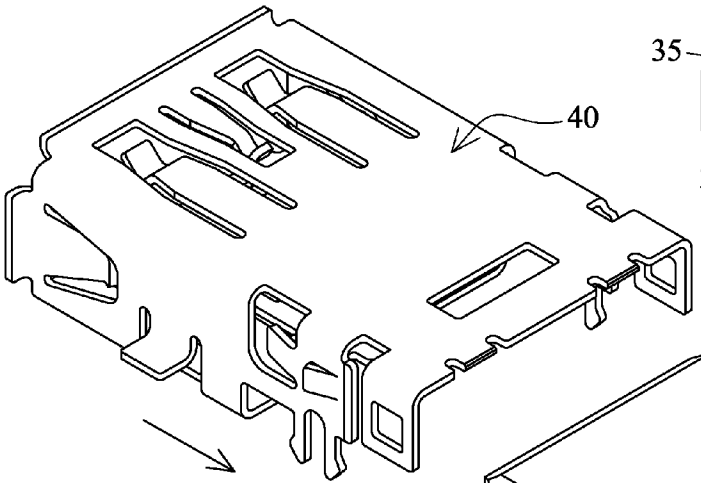
FIG. 1 (Prior Art)
FIG. 1 is a pictorially exploded view showing a conventional USB 3.0 socket.
Figure 1:
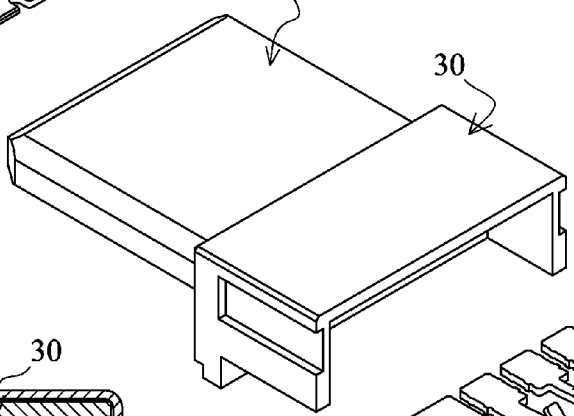
FIG. 1 (Prior Art)
Figure 1:
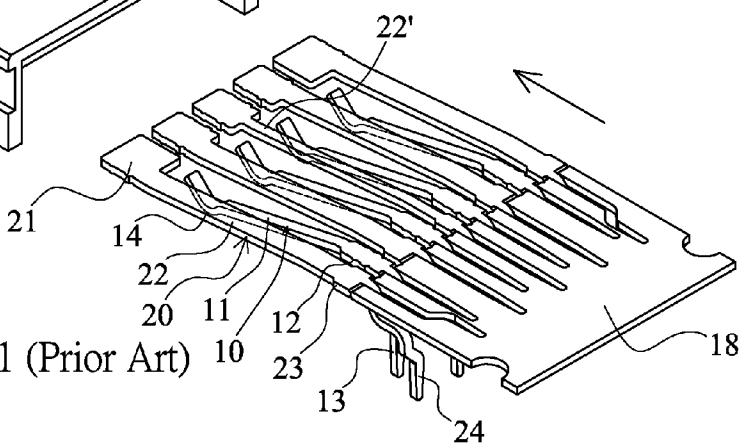
FIG. 1 (Prior Art)
Figure 2:
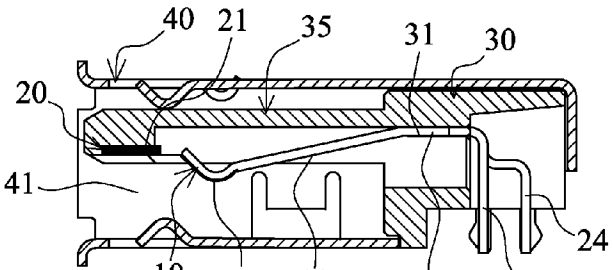
FIG. 2 (Prior Art)
FIG. 2 is a cross-sectional side view showing the conventional USB 3.0 socket.
Figures 5, 5A, 6:
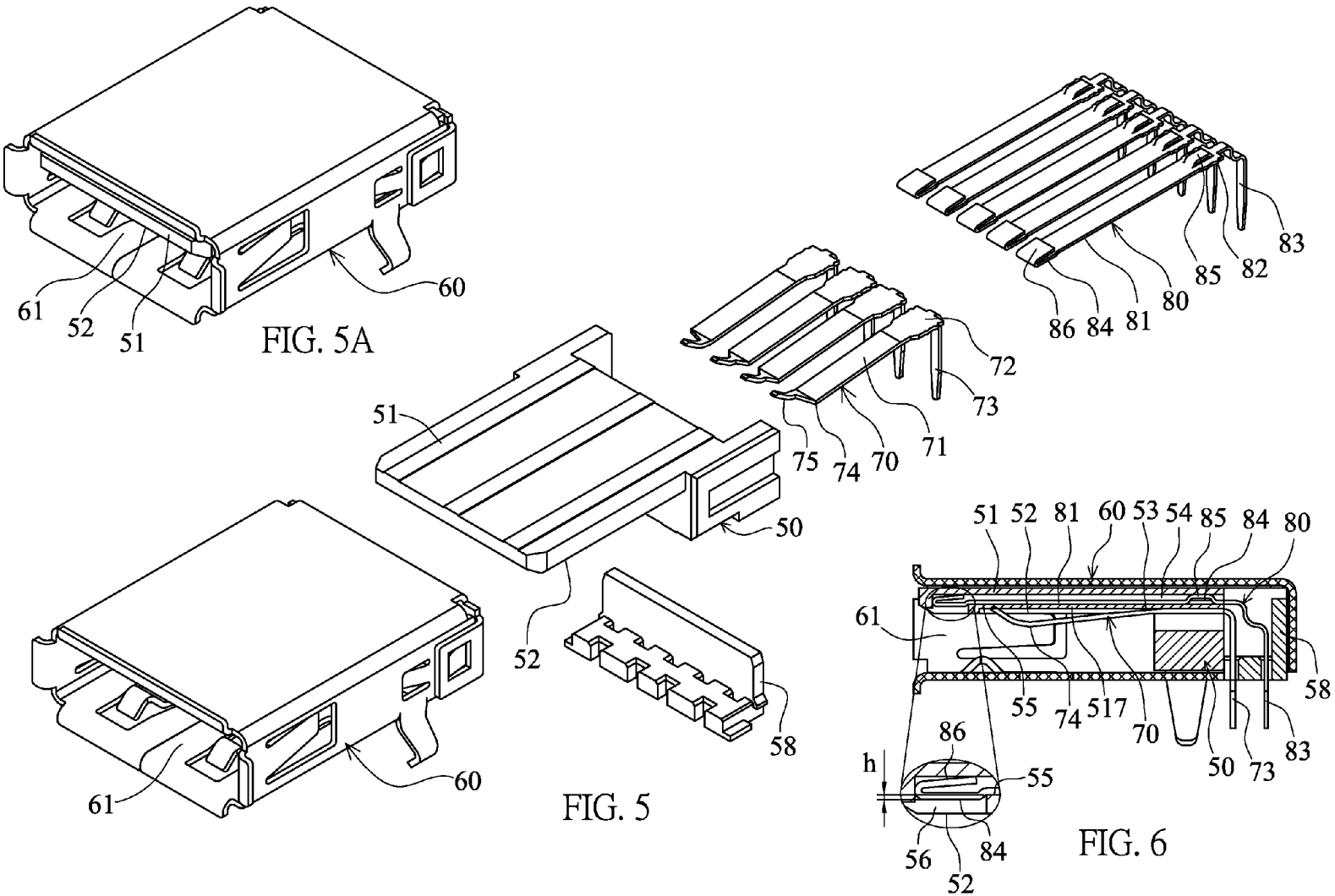
FIG. 5 is a pictorially exploded view showing a first embodiment of the invention.
FIG. 5A is a pictorially assembled view showing the first embodiment of the invention.
FIG. 6 is a cross-sectional side view showing the first embodiment of the invention with the second terminal slot 54 being cut.

The present invention will be apparent from the following detailed description, which proceeds with reference to the accompanying drawings, wherein the same references relate to the same elements.

Referring to FIGS. 5, 5A, 6 and 7, a thin USB 3.0 socket according to a first embodiment of the invention includes a plastic seat 50, a metal casing 60, one row of first terminals 70 and one row of second terminals 80.

The plastic seat 50 is integrally formed by way of plastic injection. The top end of the plastic seat 50 is frontwardly and projectingly formed with a tongue 51. The metal casing 60 is fixed to the plastic seat 50, and has an inner connection slot 61, which is disposed on the front end of the plastic seat 50 and covers the tongue 51 therein. The top surface of the tongue 51 is in flat surface contact with the top surface of the connection slot 61. The bottom surface of the tongue 51 is a connection surface 52 exposed to the connection slot 61. A plug may be inserted into the connection slot 61. The connection surface 52 is connected to the insert-connection surface of the plug, on which at least one row of connection contacts are disposed. The plastic seat 50 has one row of first terminal slots 53 and one row of second terminal slots 54 extending to the tongue 51. The one row of first terminal slots 53 are closer to the connection surface 52 than the one row of second terminal slots 54. Baffles 517 for separating the one row of first terminal slots from the one row of second terminal slots are disposed at overlapped portions in the top viewing direction. Each of assembling entrances of the one row of first and second terminal slots 53 and 54 is disposed on the rear end of the plastic seat 50. In addition, a rear cover 58 covers the plastic seat 50 from the rear of the plastic seat 50.

The one row of first terminals 70 contain four terminals, which are frontwardly assembled into the one row of first terminal slots 53 from the rear end of the plastic seat 50. The first terminal 70 is integrally formed with an extension 71, a fixing portion 72 and a pin 73 from front to rear. The fixing portion 72 is positioned in the first terminal slot 53 of the plastic seat 50. The extension 71 is connected to the front end of the fixing portion 72, extends frontwards and is curved to form a first contact 74 projecting beyond the connection surface 52. The extension 71 can be elastically moved vertically to move the first contact 74 elastically and vertically. The front of the first contact 74 has a guide-in inclined surface 75, which is narrower than the first contact 74. The guide-in inclined surfaces 75 of the first terminals 70 arranged on two sides and in the one row of first terminals are biasing structures biased inwards. The guide-in inclined surfaces 75 of the one row of first terminals in the top viewing direction are disposed in the gap between two second terminals 80. When the first contact 74 is elastically moved toward the connection surface 52, the guide-in inclined surface 75 overlaps with the second terminal 80 in the side viewing direction but does not touch the second terminal 80. The pin 73 is connected to the rear end of the fixing portion 72 and extends out of the plastic seat 50.

The one row of second terminals 80 contain five terminals, which are frontwardly assembled into the one row of second terminal slots 54 from the rear end of the plastic seat 50. The second terminal 80 is integrally formed with a second contact 84, an extension 81, a fixing portion 82 and a pin 83 from front to rear. The fixing portion 82 has an upwardly projecting fitting portion 85 tightly fitting with the second terminal slot 54 for positioning. The extension 81 is connected to the front end of the fixing portion 82 and extends frontwards. The extension 81 is attached to a resting surface 55 of the plastic seat. The resting surface 55 is the bottom surface of the second terminal slot 54. The second contact 84 is connected to the front end of the extension 81. The second contact 84 is much more depressed than the connection surface 52 and is disposed in front of the first contact 74. The front section of the second terminal slot 54 has an opening 56 so that the second contact 84 is exposed to the connection slot 61. The extension 81 and the second terminal slot 54 form a vertical gap. The front end of the second terminal 80 has a positioning portion 86 tightly fitting with the second terminal slot 54 for positioning. The positioning portion 86 is an upwardly and reversely bent elastic sheet, so that the front end of the second terminal 80 is formed with a circular arc surface. The pin 83 is connected to the rear end of the fixing portion 82 and extends out of the plastic seat 50.

Figure 8:
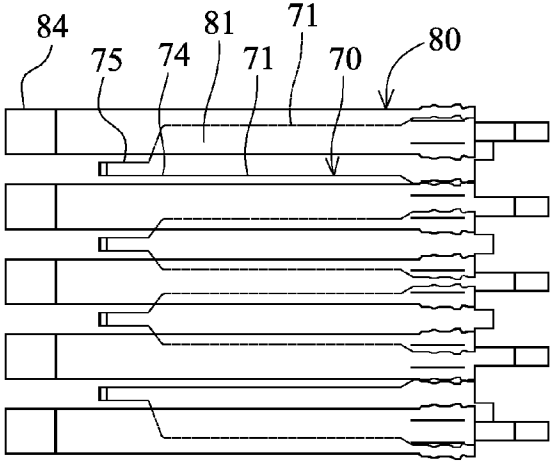
FIG. 8 is a top view showing two rows of terminals of the first embodiment of the invention.

As shown in FIG. 8, the extensions 71 of the one row of first terminals 70 at least partially overlap with the extensions 81 of the one row of second terminals 80 in the top viewing direction, or the extensions 81 and the second contacts 84 of the one row of second terminals are not turned in the top viewing direction. The extension 81 and the second contact 84 of the second terminal are flush with each other in the side viewing direction or form a step h smaller than 0.7 mm. That is, the step h may range from 0 to 0.7 mm, so that the second contact 84 is much more projected to the connection surface 52 than the resting surface 55 or the second contact 84 and the resting surface 55 are flush with each other. The height between the resting surface and the connection surface is not smaller than the height between the second contact and the connection surface.

According to the dimensions specified by the USB association, the second contact 84 is much more depressed than the connection surface 52 by 0.28 mm, so the dimension h is for gaining the space in which the first and second terminal slots 53 and 54 are disposed on the tongue 51. This embodiment adopts the dimension of 0.15 mm, so that the height between the resting surface 55 and the connection surface 52 is equal to 0.43 mm, and the thickness of the baffle 517 between the first and second terminal slots 53 and 54 and the height of the first terminal slot 53 are equal to about 0.22 mm. In the design, as the dimension h gets smaller, the second terminal 80 has the better electrical transmission and can be manufactured more easily, but the thickness of the baffle 517 between the first and second terminal slots 53 and 54 gets smaller, thereby affecting the structural strength of the plastic material.

In this invention, the extensions 71 of the one row of first terminals 70 may overlap with the extensions 81 of the one row of second terminals 80 in the top viewing direction. Thus, the first terminal 70 and the second terminal 80 may be freely arranged according to the preferred widths to achieve the better electrical transmission requirement, and satisfy the high-speed electrical transmission requirement of the advanced electronic product. In practice, the width from the rear end of the extension 71 to the first contact 74 of each of the one row of first terminals 70 may be configured to range from 0.8 mm to 1.2 mm, and the width from the rear end of the extension 81 to the second contact 84 of each of the one row of second terminals 80 may be configured to range from 0.8 mm to 1.4 mm. In this embodiment, each of the one row of first terminals 70 from the extension 71 to the first contact 74 has the same width and is not turned, and each of the one row of second terminals 80 from the extension 81 to the second contact 84 also has the same width without turning, so that the electrical transmission becomes better.

In this invention, the second contact 84 of the second terminal 80 is much more projecting toward the connection surface 52 than the resting surface 55 of the second terminal slot. When the second terminal 80 is assembled into the second terminal slot 54 from rear to front and the second contact 84 falls on the resting surface 55, the positioning portion 86 can elastically open and tightly rest against the top surface of the second terminal slot 54 for positioning. In addition, the positioning portion 86 is a reversely bent structure so that the front end of the second terminal 80 is formed with a circular arc surface, and the second terminal 80 may be assembled more smoothly.

Figure 9:
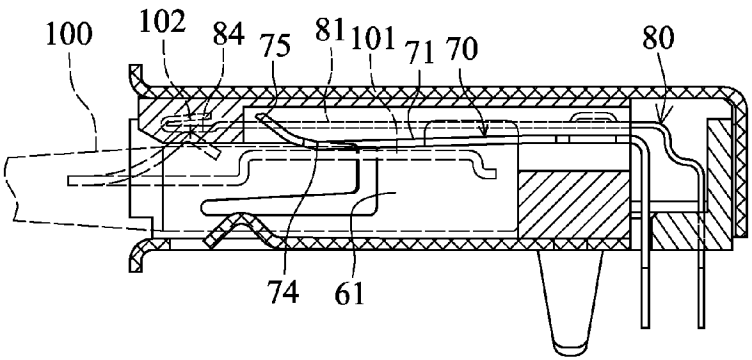
FIG. 9 shows the used state of the first embodiment of the invention.

As shown in FIG. 9, when a thin plug 100 is inserted into the connection slot 61, the extensions 71 of the one row of first terminals 70 elastically move upwardly. The guide-in inclined surface 75 is disposed in the gap between the two second terminals 80, and the guide-in inclined surface 75 overlaps with the second terminal 80 in the side viewing direction but does not touch the second terminal 80 to cause the short-circuited condition. One row of first connection contacts 101 that are not elastically movable and one row of elastically vertically movable second connection contacts 102 are disposed on the insert-connection surface of the thin plug 100. At this time, the insert-connection surface of the thin plug 100 is attached to the connection surface 52, and the one row of first connection contacts 101 that are not elastically movable are electrically connected to the one row of elastically movable first contacts 74. The one row of elastically movable second connection contacts 102 are electrically connected to the one row of second contacts 84 that are not elastically movable.

According to the above-mentioned structure, the invention is concluded to have the following advantages.

1. The extensions 71 of the one row of first terminals 70 may overlap with the extensions 81 of the one row of second terminals 80 in the top viewing direction. Thus, the first terminals 70 and the second terminals 80 may be freely arranged according to the preferred widths to achieve the better electrical transmission requirement and satisfy the high-speed electrical transmission requirement of the advanced electronic product.

2. The step of the side-viewed turning of the second contact 84 and the extension 81 of the second terminal 80 is smaller than 0.7 mm or the second contact 84 and the extension 81 are flush with each other without turning. Thus, the first and second terminal slots 53 and 54 may be disposed on the tongue 51, and the second terminal 80 also has the better electrical transmission and can be easily manufactured.

3. The front and rear sections of the one row of second terminals 80 tightly fit with the second terminal slot 54 through the fitting portion 85 of the fixing portion and the positioning portion 86, respectively, so that the one row of second terminals 80 can be combined with the plastic seat 50 and the manufacturing processes are simplified.

4. The guide-in inclined surface 75 of the first terminal 70 is narrower than the first contact 74. When the first contact 74 elastically moves toward the connection surface 52, the guide-in inclined surface 74 is disposed in the gap between the two second terminals 80, and the guide-in inclined surface 75 overlaps with the second terminal 80 in the side viewing direction but does not touch the second terminal 80 to cause the short-circuited condition.

5. The one row of first terminals 70 and the one row of second terminals 80 are integrally assembled on the plastic seat 50, so that the manufacturing processes can be simplified.

Figure 10:
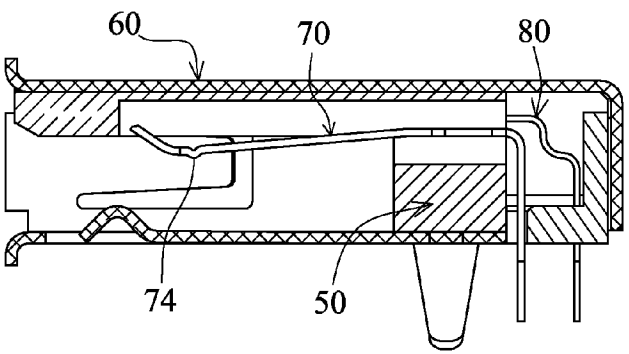
FIG. 10 is a cross-sectional side view of a second embodiment of the invention.
Figure 7:
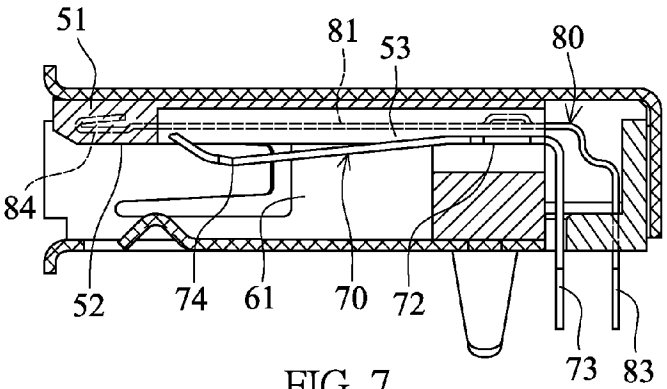
FIG. 7 is a cross-sectional side view showing the first embodiment of the invention with the first terminal slot 53 being cut.

As shown in FIG. 10, the second embodiment of the invention is substantially the same as the first embodiment except for the difference that the first contact 74 of the first terminal 70 of this embodiment is extruded into a small projection.

Figure 11:
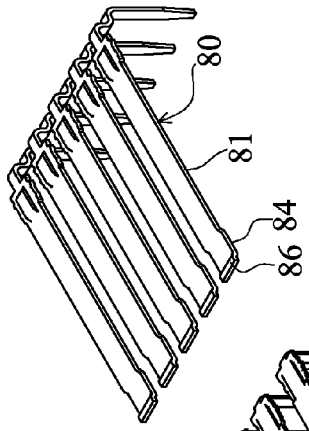
FIG. 11 is a pictorially exploded view showing a third embodiment of the invention.
Figure 11:
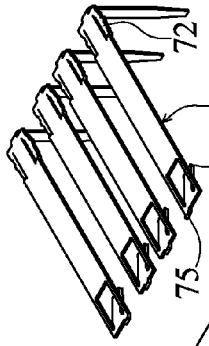
Figure 11:
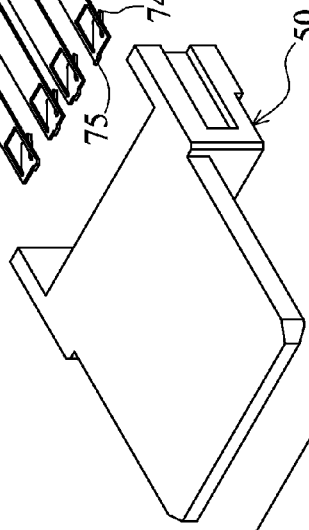
Figure 11:
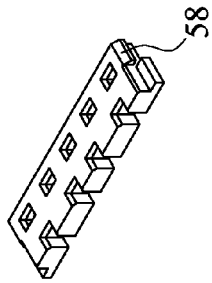
Figure 11:
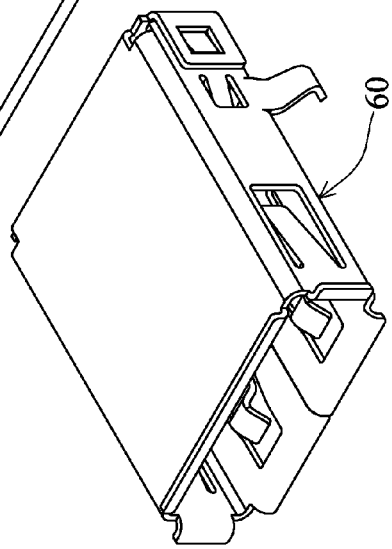
Figure 12:
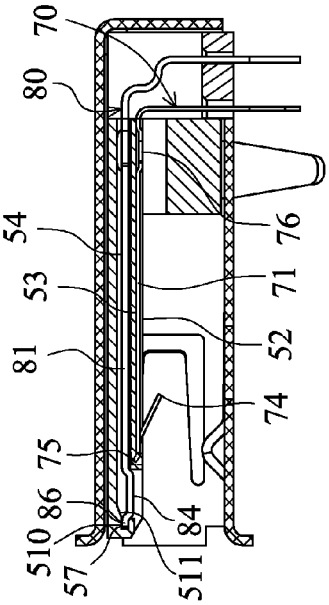
FIG. 12 is a cross-sectional side view showing the third embodiment of the invention.
Figure 13:
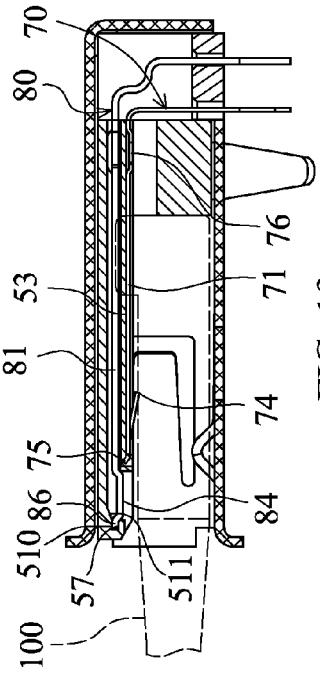
FIG. 13 shows the used state of the third embodiment of the invention.

As shown in FIGS. 11 to 13, the third embodiment of the invention is substantially the same as the first embodiment except for the difference that the front section of the top surface of the second terminal slot 54 of this embodiment has, from front to rear, a positioning surface 510 and an inclined guiding surface 511 connected together, a slot 57 is formed below the positioning surface 510, and the positioning surface 510 of the top surface of the second terminal slot 54 is a portion of the top surface of the second terminal slot 54 closest to the connection surface 52. During the assembling process, the positioning portion 86 of the front end of the second terminal 80 is guided along the inclined guiding surface 511 and into the slot 57 for engagement, the extension 71 of the first terminal 70 extends horizontally and rests against the top surface of the first terminal slot 53 of the plastic seat, and the plate surface of the extension 71 is prodded and pressed to form a projecting elastic sheet that can be elastically moved vertically. One end of the elastic sheet is connected to the extension 71, and the other end of the elastic sheet extends backwards and projects beyond the connection surface 52 to form a forward elastic sheet. The elastic sheet is the first contact 74. The fixing portion 72 has a projection 76 tightly resting against the plastic seat. In addition, the front end of the extension 71 has a guide-in inclined surface 75 with the upturned extent smaller than that of the first embodiment, and the guide-in inclined surface 75 is still disposed below the extension 81 of the second terminal 80.

As shown in FIG. 13, when the thin plug 100 is inserted into the connection slot 61, the elastic and upward movement extent of the first contact 74 of each of the one row of first terminals 70 cannot exceed the extension 71, and thus cannot touch the second terminal 80 to cause the short-circuited condition.

Figures 14, 15, 16:
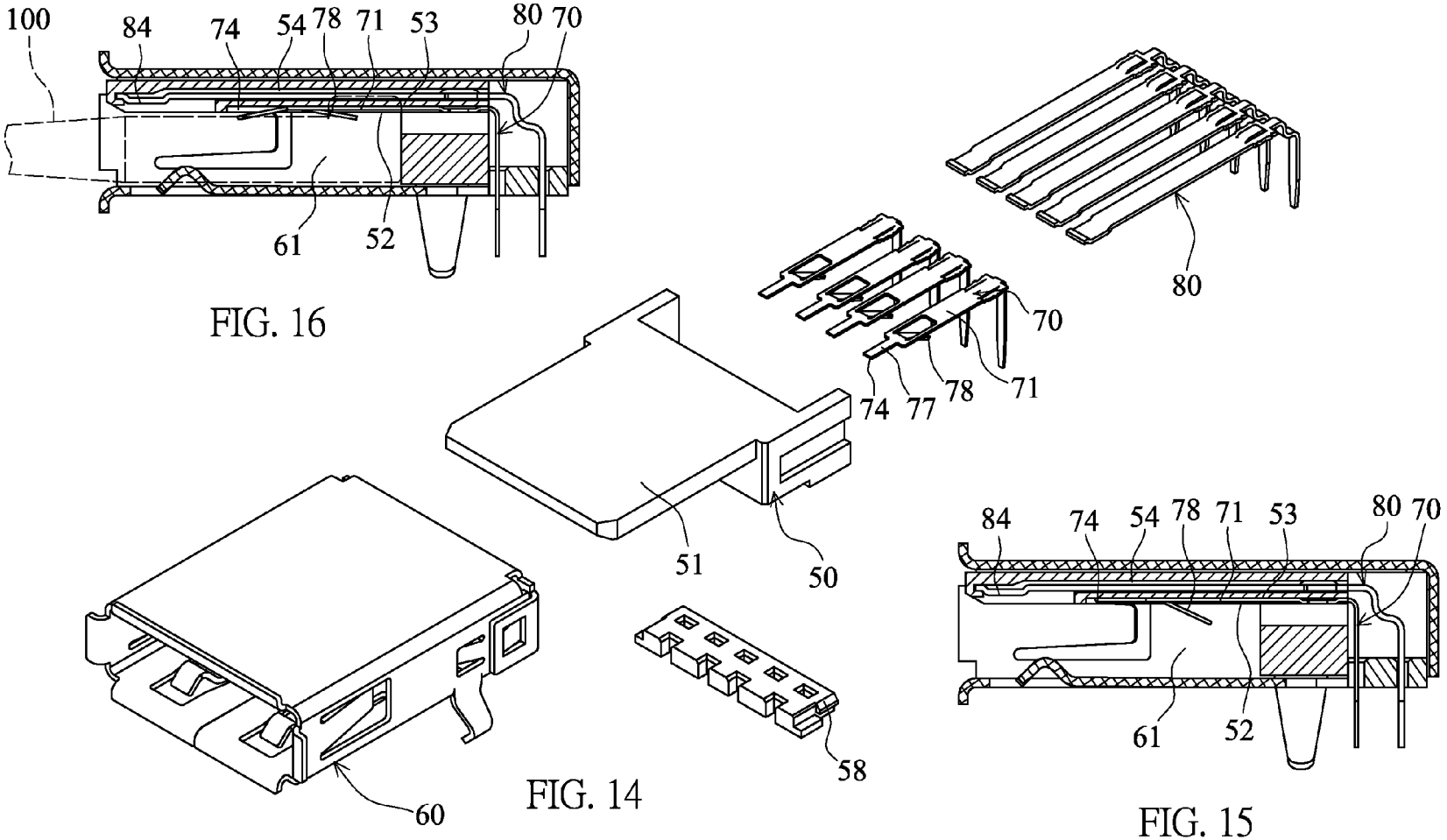
FIG. 14 is a pictorially exploded view showing a fourth embodiment of the invention.
FIG. 15 is a cross-sectional side view showing the fourth embodiment of the invention.
FIG. 16 shows the used state of the fourth embodiment of the invention.

As shown in FIGS. 14 and 15, the fourth embodiment of the invention is substantially the same as the third embodiment except for the difference that the front end of the extension 71 of the first terminal 70 of this embodiment has an elastic sheet 77, the front section of the elastic sheet is the first contact 74 and in flat surface contact with the plastic seat, and the rear section 78 of the elastic sheet projects beyond the connection surface 52.

As shown in FIG. 16, when the thin plug 100 is inserted into the connection slot 61, the rear section 78 of the elastic sheet is pressed by the plug 100 and moved toward the connection surface 52, the first contact 74 projects beyond the connection surface 52 and is electrically connected to the thin plug 100.

Figure 17:
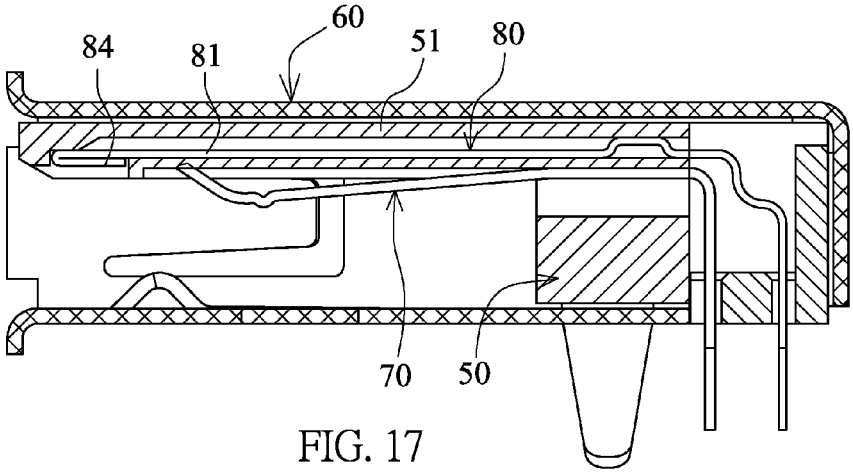
FIG. 17 is a cross-sectional side view showing a fifth embodiment of the invention.

As shown in FIG. 17, the fifth embodiment of the invention is substantially the same as the first embodiment except for the difference that the second contact 84 of the second terminal 80 of this embodiment is downwardly and inversely bent from the extension 81 and than stacked.

Figure 18:
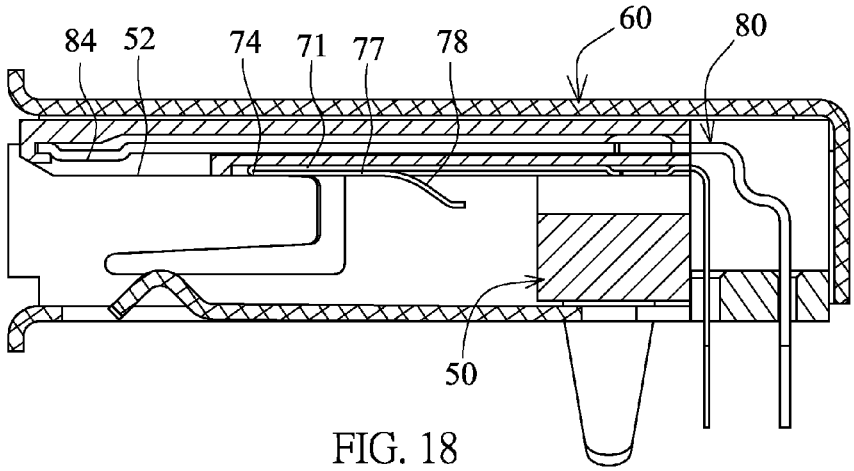
FIG. 18 is a cross-sectional side view showing a sixth embodiment of the invention.

As shown in FIG. 18, the sixth embodiment of the invention is substantially the same as the fourth embodiment except for the difference that the elastic sheet 77 of the front end of the extension 71 of the first terminal 70 of this embodiment is downwardly and inversely bent from the extension 71.

Figure 19:
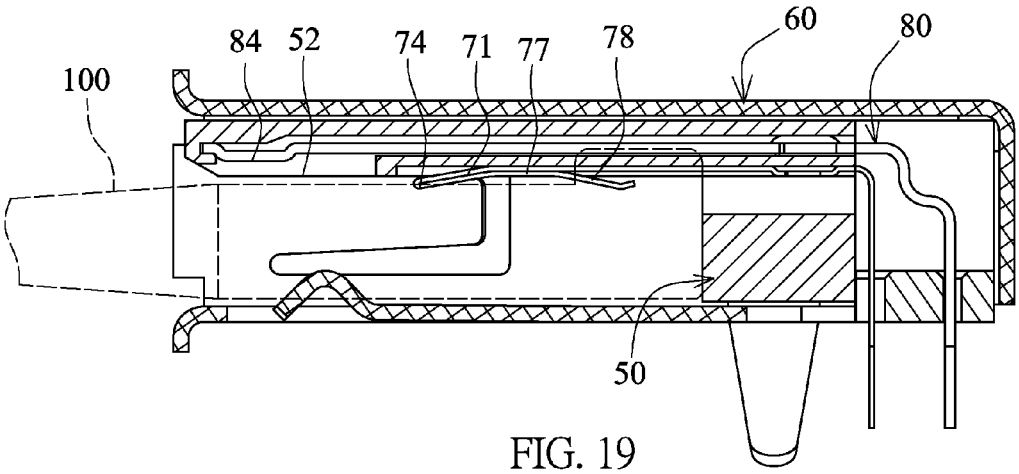
FIG. 19 shows the used state of the sixth embodiment of the invention.

As shown in FIG. 19, when the thin plug 100 is inserted into the connection slot 61, the rear section 78 of the elastic sheet is pressed by the plug 100 and moved toward the connection surface 52, the first contact 74 projects beyond the connection surface 52 and is electrically connected to the plug 100.

Figure 20:
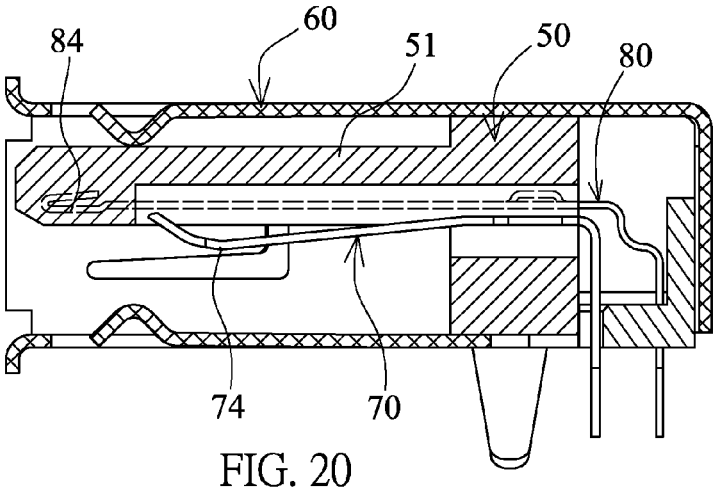
FIG. 20 is a cross-sectional side view showing a seventh embodiment of the invention.

As shown in FIG. 20, a standard USB 3.0 socket according to the seventh embodiment of the invention includes a plastic seat 50, a metal casing 60, one row of first terminals 70 and one row of second terminals 80, and is substantially the same as that of the first embodiment except for the difference that the tongue 51 of this embodiment is disposed at the upper position of the plastic seat 50, and a gap is still formed between the top surface of the tongue 51 and the top surface of the connection slot 61.

Figure 21:
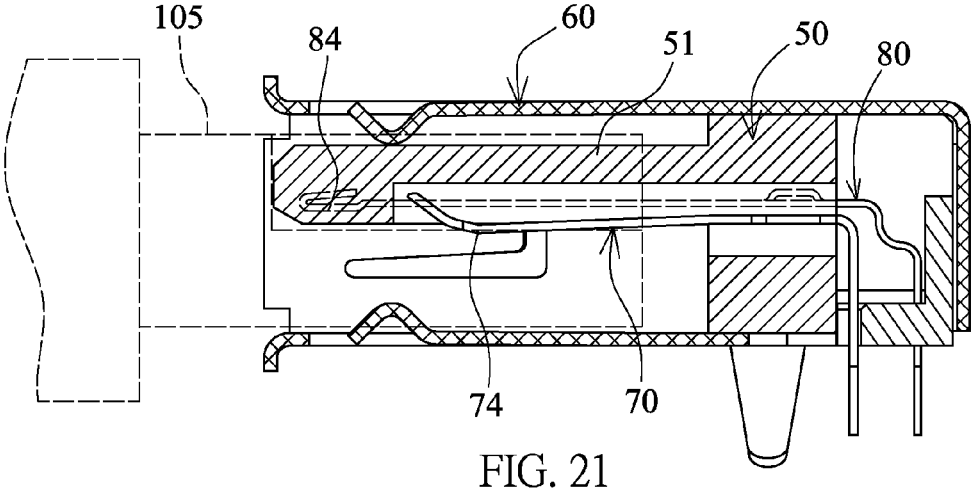
FIG. 21 shows the used state of the seventh embodiment of the invention.
Figure 22:
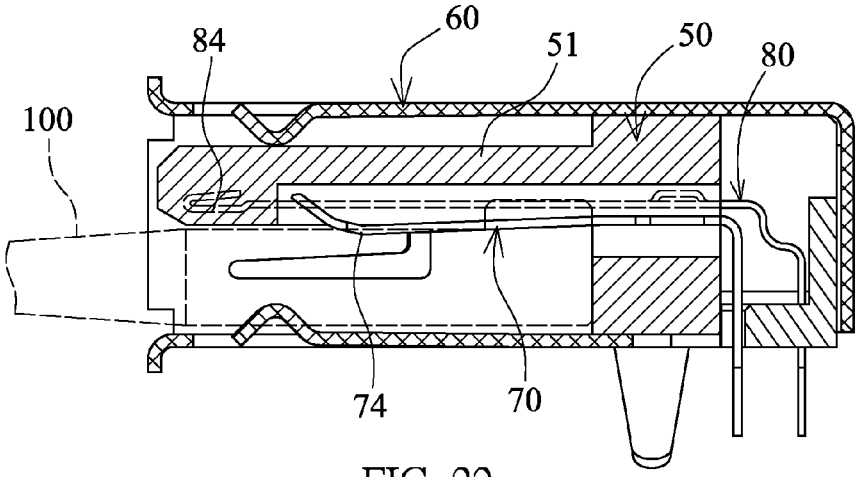
FIG. 22 shows the used state of the seventh embodiment of the invention.

According to the above-mentioned structure, as shown in FIG. 21, an iron-case-type plug 105 can be inserted into and electrically connected to the socket of this embodiment, wherein the iron-case-type plug 105 includes an external iron case. As shown in FIG. 22, a thin plug 100 may also be inserted into and electrically connected to the socket of this embodiment.

Figure 23:
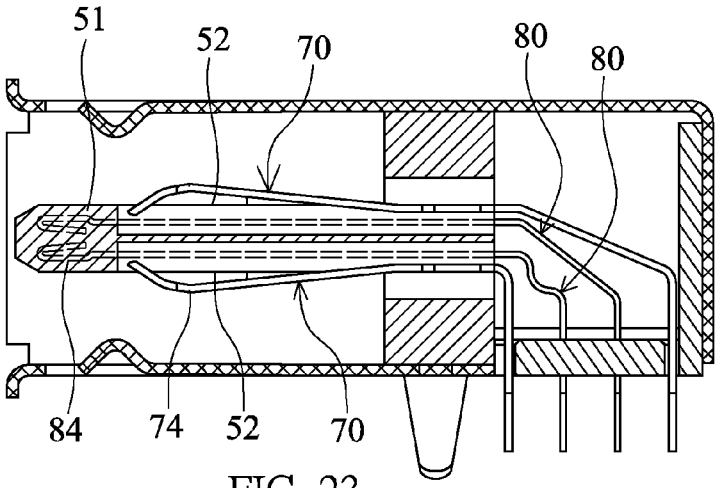
FIG. 23 is a cross-sectional side view showing an eighth embodiment of the invention.

As shown in FIG. 23, the eighth embodiment of the invention is a bidirectionally insertable USB 3.0 socket including a plastic seat 50, a metal casing 60, two rows of first terminals 70 and two rows of second terminals 80, and is substantially the same as that of the first embodiment except for the difference that the tongue 51 of this embodiment is disposed at the middle position of the plastic seat 50, the tongue 51 is also disposed at the middle position of the connection slot 61, each of the top and bottom surfaces of the tongue 51 is a connection surface 52, and the two rows of first terminals 70 and the two rows of second terminals 80 are correspondingly disposed on the two connection surfaces 52, respectively.

Figure 24:
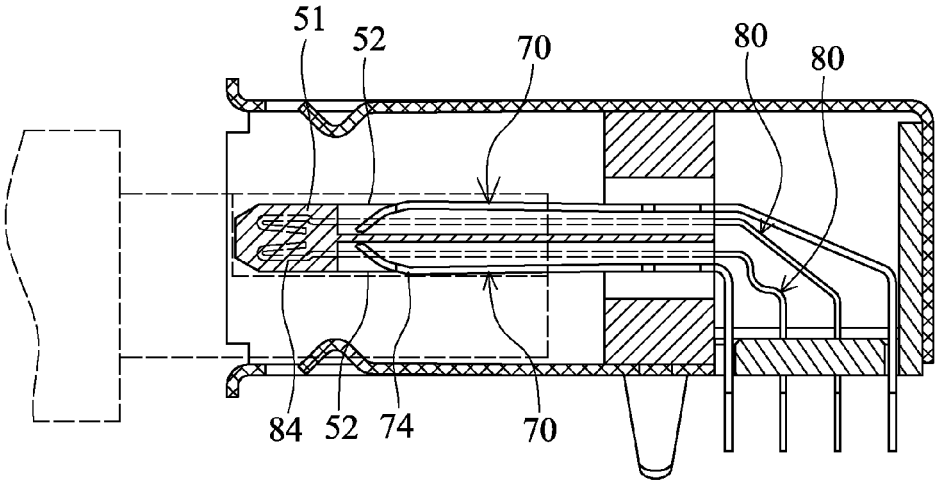
FIG. 24 shows the used state of the eighth embodiment of the invention.
Figure 25:
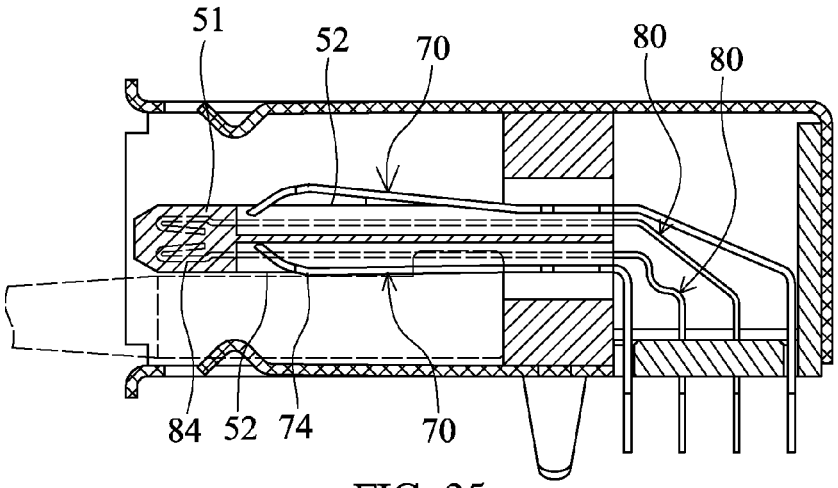
FIG. 25 shows the used state of the eighth embodiment of the invention.

According to the above-mentioned structure, as shown in FIG. 24, an iron-case-type plug 105 may be bidirectionally inserted into the socket of this embodiment for electrical connection. The iron-case-type plug 105 may be either forward or reversely inserted into the socket and electrically connected to one row of first terminals 70 and one row of second terminals 80 on one connection surface 52. As shown in FIG. 25, a thin plug 100 may be inserted into the socket and above or below the tongue 51 of this embodiment for electrical connection.

Figure 26:
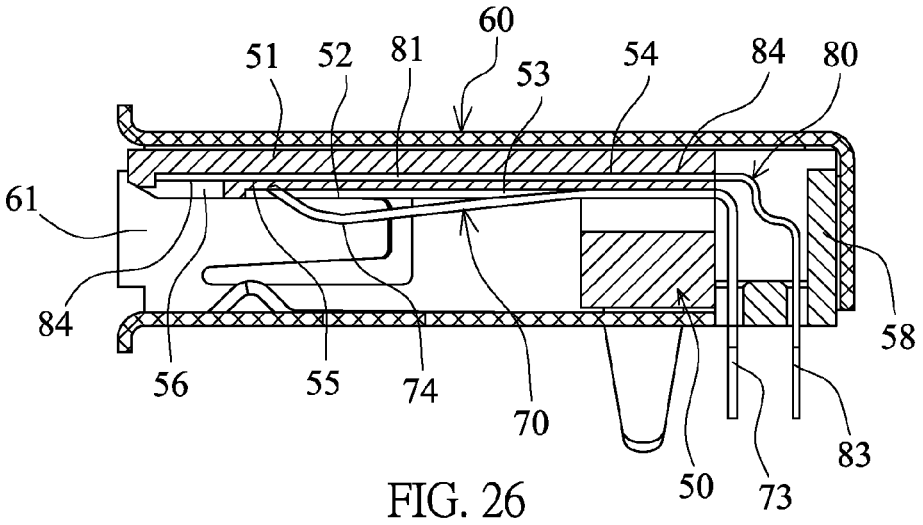
FIG. 26 is a cross-sectional side view showing a ninth embodiment of the invention.

As shown in FIG. 26, the ninth embodiment of the invention is substantially the same as the first embodiment except for the difference that no vertical gap is formed between the extension 81 of the second terminal of this embodiment and the second terminal slot 54 in the vertical direction, and the extension 81 and the second contact 84 of the second terminal 80 are flush with each other in the side viewing direction without turning so that the second contact 84 is flush with the resting surface 55. The height between the resting surface 55 and the connection surface 52 is equal to the height between the second contact 84 and the connection surface 52, and is equal to 0.28 mm. The thickness of the plastic material between the first and second terminal slots 53 and 54 and the height of the first terminal slot 53 are equal to about 0.14 mm.

Figure 27:
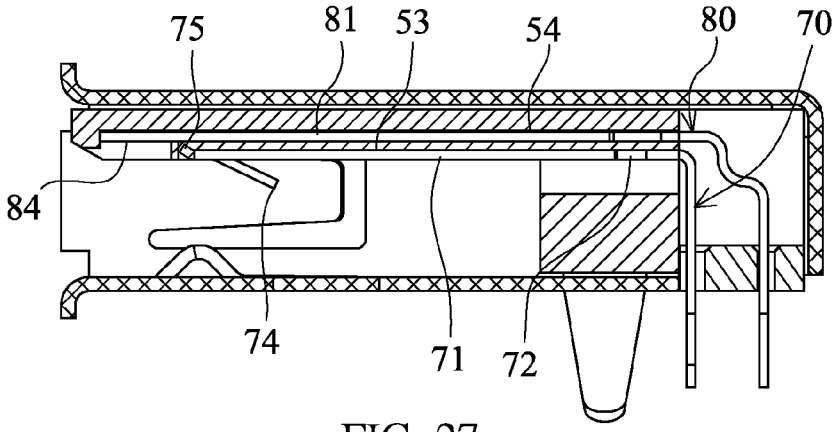
FIG. 27 is a cross-sectional side view showing a tenth embodiment of the invention.

As shown in FIG. 27, the tenth embodiment of the invention is substantially the same as the third embodiment except for the difference that no vertical gap is formed between the extension 81 and the second terminal slot 54 of the second terminal of this embodiment in the vertical direction, and the extension 81 and the second contact 84 of the second terminal 80 are flush with each other in the side viewing direction without turning, so that the second contact 84 is flush with the resting surface 55. The height between the resting surface 55 and the connection surface 52 is equal to the height between the second contact 84 and the connection surface 52, and is equal to 0.28 mm. The thickness of the plastic material between the first and second terminal slots 53 and 54 and the height of the first terminal slot 53 are equal to about 0.14 mm.

Figure 28:
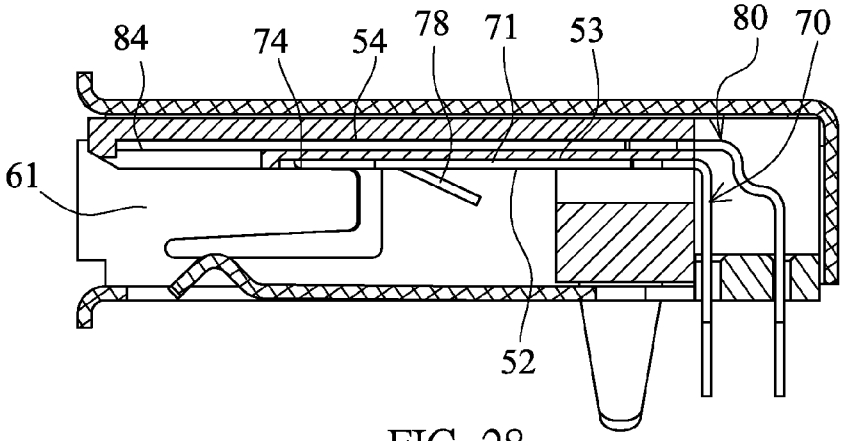
FIG. 28 is a cross-sectional side view showing an eleventh embodiment of the invention.
Figure 29:
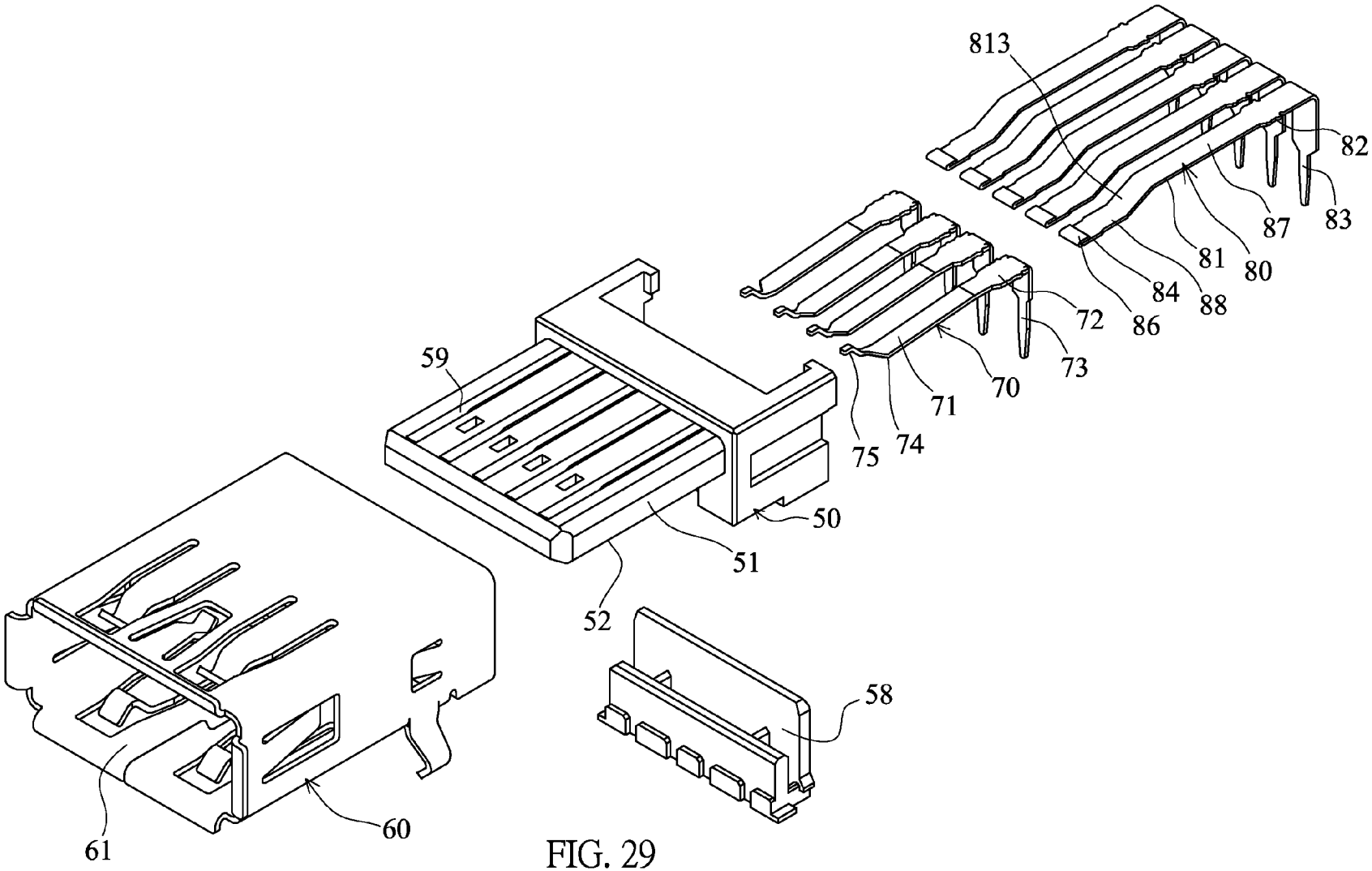
FIG. 29 is a pictorially exploded view showing a twelfth embodiment of the invention.

As shown in FIG. 28, the eleventh embodiment of the invention is substantially the same as the fourth embodiment except for the difference that no vertical gap is formed between the extension 81 and the second terminal slot 54 of the second terminal of this embodiment in the vertical direction, and the extension 81 and the second contact 84 of the second terminal 80 are flush with each other in the side viewing direction without turning, so that the second contact 84 is flush with the resting surface 55. The height between the resting surface 55 and the connection surface 52 is equal to the height between the second contact 84 and the connection surface 52 and is equal to 0.28 mm. The thickness of the plastic material between the first and second terminal slots 53 and 54 and the height of the first terminal slot 53 are equal to about 0.14 mm.

As shown in FIGS. 29 to 35, a standard USB 3.0 socket according to a twelfth embodiment of the invention includes a plastic seat 50, a metal casing 60, one row of first terminals 70 and one row of second terminals 80.

The plastic seat 50 is integrally formed by way of plastic injection, and has an upper end frontwardly and projectingly formed with a tongue 51. The metal casing 60 is fixed to the plastic seat 50, and has an inner connection slot 61 disposed on the front end of the plastic seat 50 and covers the tongue 51 therein. The tongue 51 is horizontally disposed in the upper space of the connection slot 61, and is separated from the top surface of the metal casing 60 by a gap. Only the bottom surface of the tongue 51 is a connection surface 52 exposed to the connection slot 61. A plug may be inserted into the connection slot 61. The connection surface 52 faces the insert-connection surface of the plug. At least one row of connection contacts are disposed on the insert-connection surface of the plug. The plastic seat 50 has one row of first terminal slots 53 and one row of second terminal slots 54 extending from the rear end to the tongue 51. The one row of first terminal slots 53 are closer to the connection surface 52 than the one row of second terminal slots 54. Baffles 517 for separating the one row of first terminal slots 53 from the one row of second terminal slots 54 are disposed at overlapped portions in the top viewing direction. One surface of the second terminal slot close to the connection surface 52 is a resting surface 55. The assembling entrances of the one row of first and second terminal slots 53 and 54 are disposed on the rear end of the plastic seat 50. The front section of the surface of the second terminal slot 54 away from the connection surface has, from front to rear, a positioning surface 510, an inclined guiding surface 511, a first horizontal surface 512, an inclined surface 513 and a second horizontal surface 514 connected together. The positioning surface 510 is closer to the connection surface 52 than the first horizontal surface 512, and the first horizontal surface 512 is closer to the connection surface 52 than the second horizontal surface 514. Slots 515 and 516 are respectively disposed above the rear end of the first and second terminal slots 53 and 54. The other surface of the tongue 51 opposite to the connection surface 52 has one row of open slots 59 extending in a front-to-rear direction. The one row of open slots 59 correspond to the one row of second terminal slots 54. In addition, a rear cover 58 is provided to cover the plastic seat 50 from the rear end of the plastic base 50.

Figure 32:
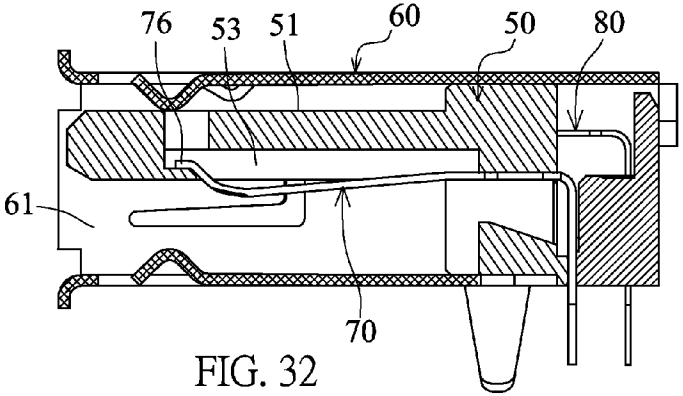
FIG. 32 is a cross-sectional side view showing the twelfth embodiment of the invention with the first terminal slot 53 being cut.
Figure 33:
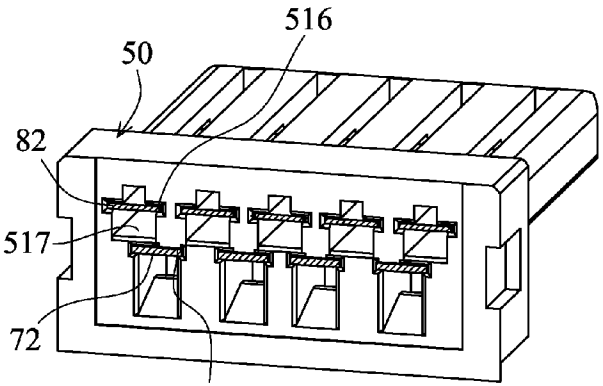
FIG. 33 is a pictorial view showing the plastic seat of the twelfth embodiment of the invention.
Figure 30:
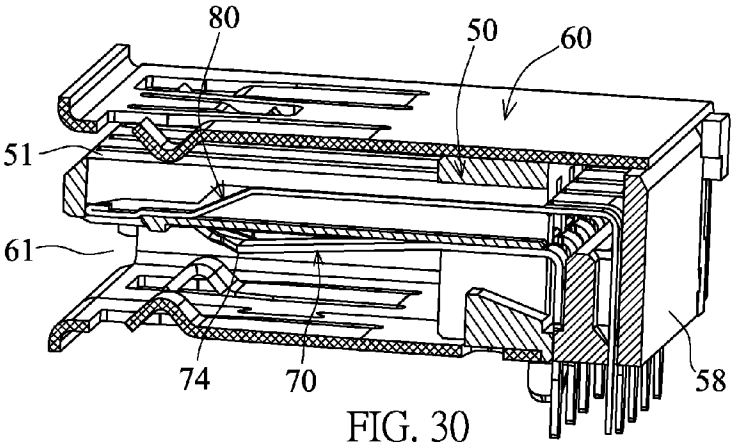
FIG. 30 is a pictorially cross-sectional view showing the twelfth embodiment of the invention.
Figure 31:
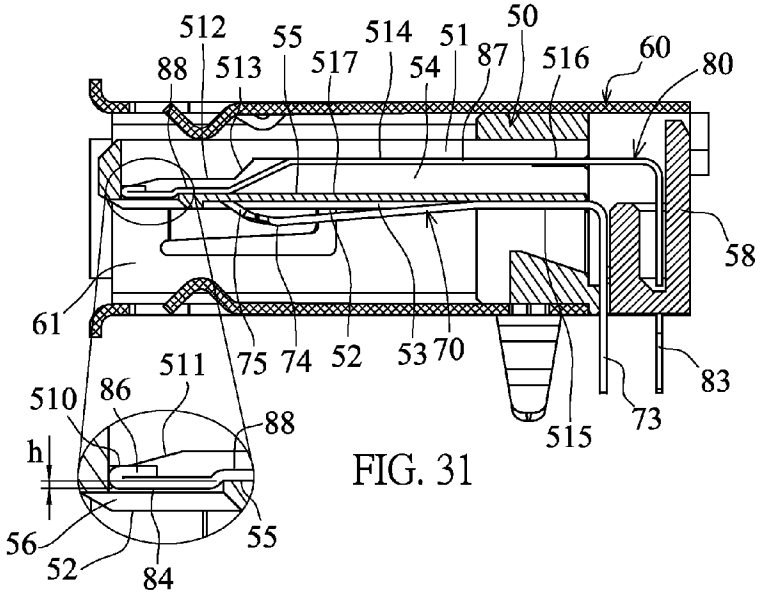
FIG. 31 is a cross-sectional side view showing the twelfth embodiment of the invention with the second terminal slot 54 being cut.

The one row of first terminals 70 contain four terminals and are frontwardly assembled into the one row of first terminal slots 53 from the rear end of the plastic seat 50. The first terminal 70 is integrally formed with an extension 71, a fixing portion 72 and a pin 73 from front to rear. The fixing portion 72 engages with the slot 515 of the first terminal slot 53 of the plastic seat 50. The extension 71 is connected to the front end of the fixing portion 72, extends frontwards and is curved to form a first contact 74 projecting beyond the connection surface 52. The extension 71 can be elastically moved vertically to move the first contact 74 elastically and vertically. A guide-in inclined surface 75 is formed on the front end of the first contact 74. The guide-in inclined surface 75 is narrower than the first contact 74. The guide-in inclined surfaces 75 of the first terminals 70 arranged on two sides and in the one row of first terminals are biasing structures biased inwards. The guide-in inclined surfaces 75 of the one row of first terminals in the top viewing direction are disposed in the gap between the extensions 81 of the two second terminals 80. When the first contact 74 is elastically moved toward the connection surface 52, the guide-in inclined surface 75 overlaps with the extension 81 of the second terminal 80 in the side viewing direction but does not touch the extension 81 of the second terminal 80. The pin 73 is connected to the rear end of the fixing portion 72 and extends out of the plastic seat 50. In addition, as shown in FIG. 32, the front end 79 of the first terminal 70 rests against the plastic seat 50, so that the first terminal 70 is preloaded to project toward the connection surface 52.

The one row of second terminals 80 contain five terminals and are frontwardly assembled into the one row of second terminal slots 54 from the rear end of the plastic seat 50. The second terminal 80 is integrally formed with a second contact 84, an extension 81, a fixing portion 82 and a pin 83 from front to rear. The fixing portion 82 engages with the slot 516 of the second terminal slot 54 of the plastic seat 50. The extension 81 is connected to the front end of the fixing portion 82 and extends frontwards. The extension 81 has, from rear to front, a horizontal first stage 87 and a horizontal second stage 88, an inclined section 813 is formed between the first and second stages 87 and 88, and an included angle between the inclined section 813 and the first stage 87 is greater than 110 degrees, and is equal to about 150 degrees. Thus, the extension 81 can be easily pushed forward when the second terminal 80 is being assembled. The second stage 88 rests against the resting surface 55 of the second terminal slot. The first stage 87 rests against one surface (i.e., the horizontal surface 514) of the second terminal slot opposite to the resting surface 55. The second contact 84 is connected to the front end of the extension 81. The second contact 84 is much more depressed than the connection surface 52 and disposed in front of the first contact 74. The front section of the second terminal slot 54 has an opening 56 so that the second contact 84 is exposed to the connection slot 61. The front end of the second terminal 80 has a positioning portion 86 resting against the positioning surface 510 of the second terminal slot 54 for positioning. The positioning portion 86 is a reversely bent structure and stacked on the second contact 84, so that the front end of the second terminal is formed with a circular arc surface. The pin 83 is connected to the rear end of the fixing portion 82 and extends out of the plastic seat 50. In addition, the second terminal 80 from the second contact 84 to the extension 81 can expose one surface of the tongue 51 through the open slot 59, so that the high-speed or high-frequency transmission is better.

Figure 35:
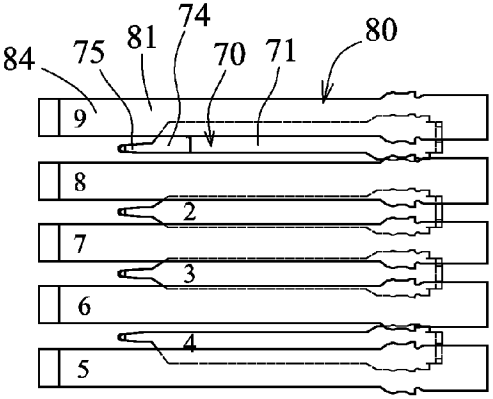
FIG. 35 is a top view showing the arrangement of the two rows of terminals of the twelfth embodiment of the invention.

As shown in FIG. 35, the one row of first terminals 70 and the one row of second terminals 80 are arranged to form the USB 3.0 interface, wherein the serial numbers of the one row of first terminals 70 are arranged as 1, 2, 3, 4; the serial numbers of the one row of second terminals 80 are arranged as 5, 6, 7, 8, 9; and the one row of second terminals 80 sequentially include one pair of signal terminals (arranged serial numbers are 5, 6), a ground terminal (the arranged serial number is 7) and the other pair of signal terminals (arranged serial numbers are 8, 9).

Figure 34:
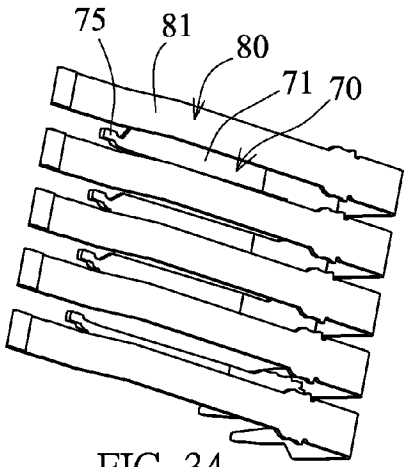
FIG. 34 is a pictorial view showing the arrangement of two rows of terminals of the twelfth embodiment of the invention.

As shown in FIGS. 34 and 35, the extensions 71 of the one row of first terminals 70 at least partially overlap with the extensions 81 of the one row of second terminals 80 in the top viewing direction. A step h is formed between the second stage 88 of the extension 81 of the second terminal and the second contact 84 in the side viewing direction, wherein the step h is smaller than 0.7 mm. That is, the step h may range from 0 to 0.7 mm, so that the second contact 84 is much more projected to the connection surface 52 than the resting surface 55 or the second contact 84 and the resting surface 55 are flush with each other. The height between the resting surface 55 and the connection surface 52 is not smaller than the height between the second contact 84 and the connection surface 52.

According to the dimensions specified by the USB association, the second contact 84 is much more depressed than the connection surface 52 by 0.28 mm, so the dimension h is for gaining the space in which the first and second terminal slots 53 and 54 are disposed on the tongue 51. This embodiment adopts the dimension of 0.15 mm, so that the height between the resting surface 55 and the connection surface 52 is equal to 0.43 mm, and the thickness of the baffle 517 between the first and second terminal slots 53 and 54 and the height of the first terminal slot 53 are equal to about 0.22 mm. In the design, as the dimension h gets smaller, the second terminal 80 has the better electrical transmission and can be manufactured more easily, but the thickness of the baffle 517 between the first and second terminal slots 53 and 54 gets smaller, thereby affecting the structural strength of the plastic material.

In this invention, the extensions 71 of the one row of first terminals 70 may overlap with the extensions 81 of the one row of second terminals 80 in the top viewing direction. Thus, the first terminal 70 and the second terminal 80 may be freely arranged according to the preferred widths to achieve the better electrical transmission requirement, and satisfy the high-speed electrical transmission requirement of the advanced electronic product. In practice, the width from the rear end of extension 71 to the first contact 74 of each of the one row of first terminals 70 may be configured to range from 0.8 mm to 1.2 mm, and the width from the rear end of the extension 81 to the second contact 84 of each of the one row of second terminals 80 may be configured to range from 0.8 mm to 1.4 mm. In this embodiment, each of the one row of first terminals 70 from the extension 71 to the first contact 74 has the same width and is not turned, and each of the one row of second terminals 80 from the extension 81 to the second contact 84 also has the same width without turning, so that the electrical transmission becomes better.

In this invention, the second contact 84 of the second terminal 80 is much more projecting toward the connection surface 52 than the resting surface 55 of the second terminal slot. When the second terminal 80 is assembled into the second terminal slot 54 from rear to front, the positioning portion 86 can be guided into and rest against the positioning surface 510 along the inclined guiding surface 511 and positioned. In addition, the positioning portion 86 has a reversely bent structure so that the front end of the second terminal 80 is formed with a circular arc surface, and the second terminal 80 may be assembled more smoothly.

Figure 36:
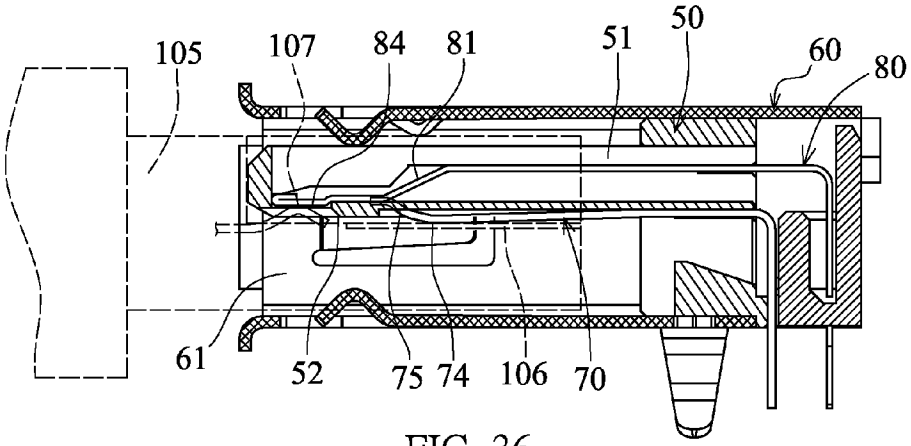
FIG. 36 shows the used state of the twelfth embodiment of the invention.

As shown in FIG. 36, when an iron-case-type plug 105 is inserted into the connection slot 61, the extensions 71 of the one row of first terminals 70 elastically move upwardly, and the guide-in inclined surface 75 is disposed in the gap between the extensions 81 of the two second terminals 80, the guide-in inclined surface 75 overlaps with the second terminal 80 in the side viewing direction but does not touch the extension 81 of the second terminal 80 to cause the short-circuited condition. One row of first connection contacts 106 that cannot elastically move and one row of elastically and vertically movable second connection contacts 107 are disposed on the insert-connection surface of the iron-case-type plug 105. At this time, the insert-connection surface of the iron-case-type plug 105 is attached to the connection surface 52, and the one row of first connection contacts 106 that cannot elastically move are electrically connected to the one row of elastically movable first contacts 74, and the one row of elastically movable second connection contacts 107 are electrically connected to the one row of second contacts 84 that are not elastically movable electrically.

According to the above-mentioned structure, this embodiment has the above-mentioned and following advantages.

1. The other surface of the tongue 51 opposite to the connection surface 52 is formed with one row of open slots extending in a front-to-rear direction 59, so that the one row of second terminals 80 are exposed from the open slots and the high-speed or high-frequency transmission is better.

2. When the second terminal 80 is assembled into the second terminal slot 54 from rear to front, the positioning portion 86 can be guided into and rest against the positioning surface 510 along the inclined guiding surface 511 and positioned.

3. The positioning portion 86 has the reversely bent structure, so that the front end of the second terminal 80 is formed with a circular arc surface, and the second terminal 80 may be assembled more smoothly.

4. The extension of the second terminal 80 has the first stage 87 and the second stage 88 located at different levels, and the first stage 87 and the second stage 88 respectively rest against the top and bottom surfaces of the second terminal slot 54 and can be stably positioned. In addition, the first stage 87 rises the extension of the second terminal 80 so that the extension of the second terminal 80 is separated from the extension 71 of the first terminal 70 by a larger gap and the electrical interference can be reduced.

5. An inclined section 813 is formed between the first and second stages 87 and 88, and the included angle between the inclined section 813 and the first stage 87 is greater than 110 degrees, and equal to about 150 degrees, so that the extension 81 can be easily pushed forward when the second terminal 80 is being assembled.

Figure 37:
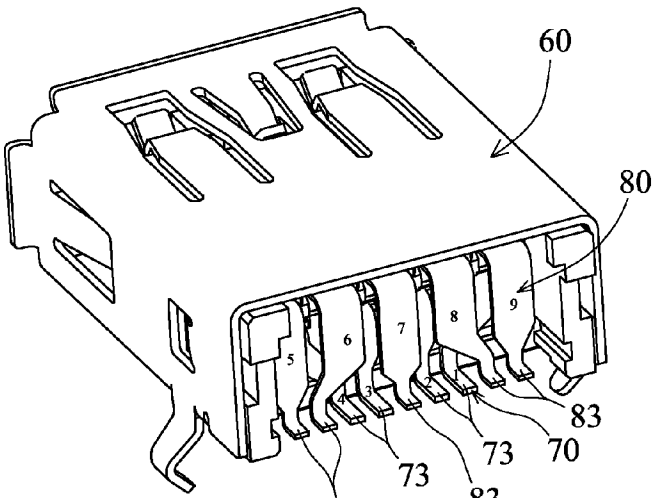
FIG. 37 is a pictorial view showing a thirteenth embodiment of the invention.

As shown in FIG. 37, the thirteenth embodiment of the invention is substantially the same as the twelfth embodiment except for the difference that the pins 73 of the one row of first terminals 70 and the pins 83 of the one row of second terminals 80 of this embodiment are arranged in a horizontal row and in the left-to-right direction. The pins 83 of one pair of signal terminals (arranged serial numbers are 5, 6) of the one row of second terminals 80 are arranged on one side. The pins 83 of the other pair of signal terminals (arranged serial numbers are 8, 9) are arranged on the other side. The pin 83 of the ground terminal (the arranged serial number is 7) is arranged at the middle. The pins 73 of the sequential two terminals (the arranged serial numbers are 1, 2) of the one row of first terminals are arranged between the one pair of signal terminals (arranged serial numbers are 8, 9) of the one row of second terminals and the pin of the ground terminal (the arranged serial number is 7). The pins 73 of the other sequential two terminals (arranged serial numbers are 3, 4) of the one row of first terminals are arranged between the ground terminal (the arranged serial number is 7) of the one row of second terminals and the pins of the other pair of signal terminals (arranged serial numbers are 5, 6).

Figure 38:
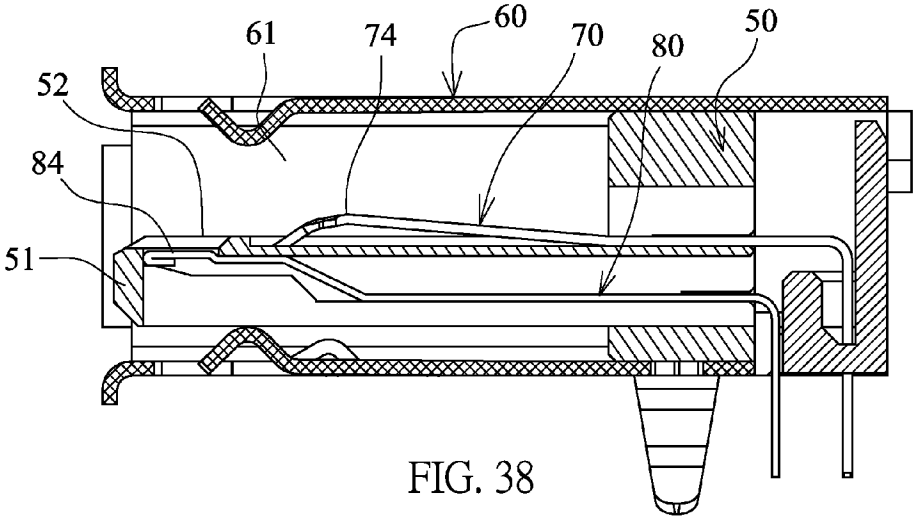
FIG. 38 is a cross-sectional side view showing a $14^{th}$ embodiment of the invention.

As shown in FIG. 38, the 14$^{th}$ embodiment of the invention is substantially the same as the twelfth embodiment except for the difference that the lower end of the plastic seat 50 of this embodiment is frontwardly and projectingly formed with a tongue 51. The tongue 51 is horizontally disposed in the lower space of the connection slot 61. The top surface of the tongue 51 is the connection surface 52. The first contacts 74 of the one row of first terminals 70 and the second contacts 84 of the one row of second terminals 80 are exposed from the connection surface 52.

Figure 39:
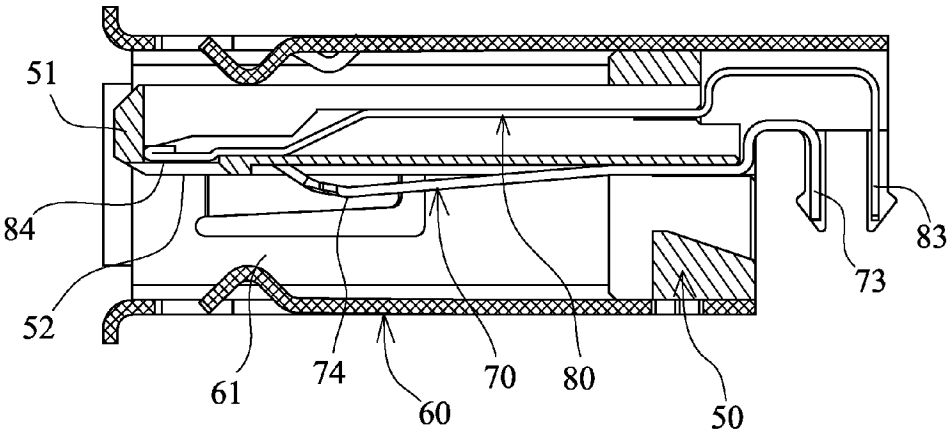
FIG. 39 is a cross-sectional side view showing a $15^{th}$ embodiment of the invention.

As shown in FIG. 39, the 15$^{th}$ embodiment of the invention is substantially the same as the twelfth embodiment except for the difference that this embodiment has the counter board design. That is, the pins 73 and 83 of the one row of first and second terminals 70 and 80 are raised to be higher than the bottom portion of the plastic seat 50.

Figure 40:
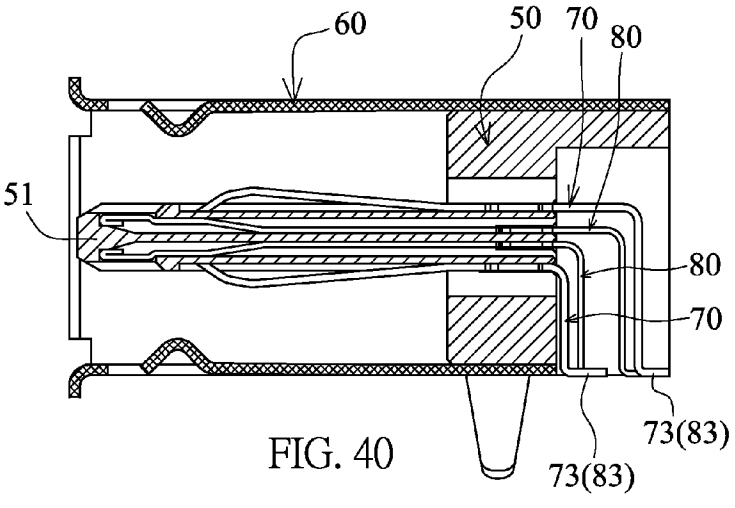
FIG. 40 is a cross-sectional side view showing a $16^{th}$ embodiment of the invention.
Figure 41:
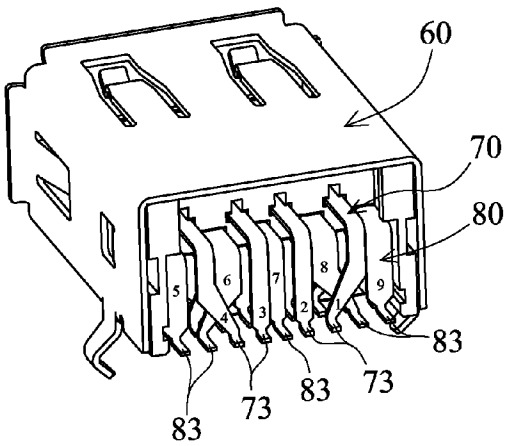
FIG. 41 is a pictorial view showing the $16^{th}$ embodiment of the invention.

As shown in FIGS. 40 and 41, the 16$^{th}$ embodiment of the invention is substantially the same as the eighth embodiment except for the difference that the pins 73 of the one row of first terminals 70 and the pins 83 of the one row of second terminals 80 on the top surface of the tongue 51 of this embodiment are horizontally arranged in one rear row, and the pins 73 of the one row of first terminals 70 and the pins 83 of the one row of second terminals 80 on the bottom surface of the tongue are horizontally arrange in one front row. The arrangement of the front and rear rows of pins is the same as that of the thirteenth embodiment.

Figure 42:
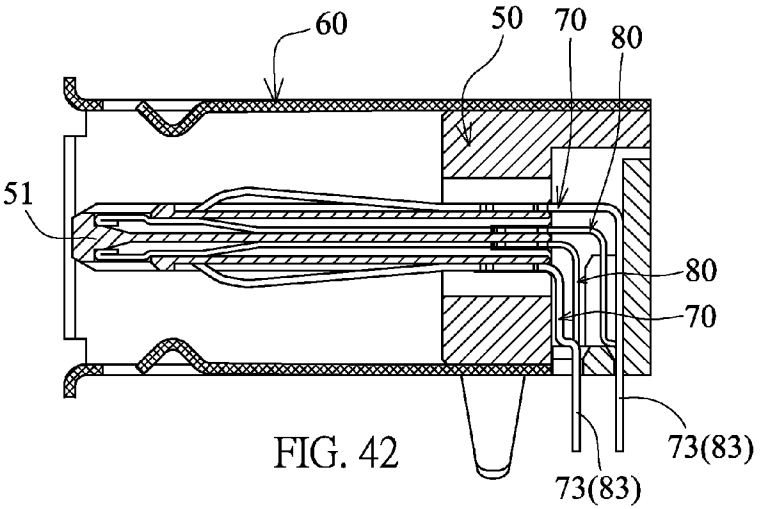
FIG. 42 is a cross-sectional side view showing a $17^{th}$ embodiment of the invention.
Figure 43:
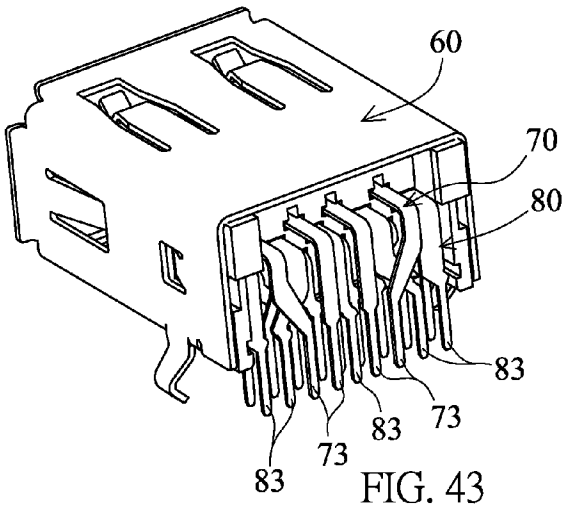
FIG. 43 is a pictorial view showing the $17^{th}$ embodiment of the invention.

As shown in FIGS. 42 and 43, the 17$^{th}$ embodiment of the invention is substantially the same as the 16$^{th}$ embodiment except for the difference that the pins of this embodiment are longitudinally arranged in two rows. The arrangement of the front and rear rows of pins is the same as that of the 16$^{th}$ embodiment.

Figure 44:
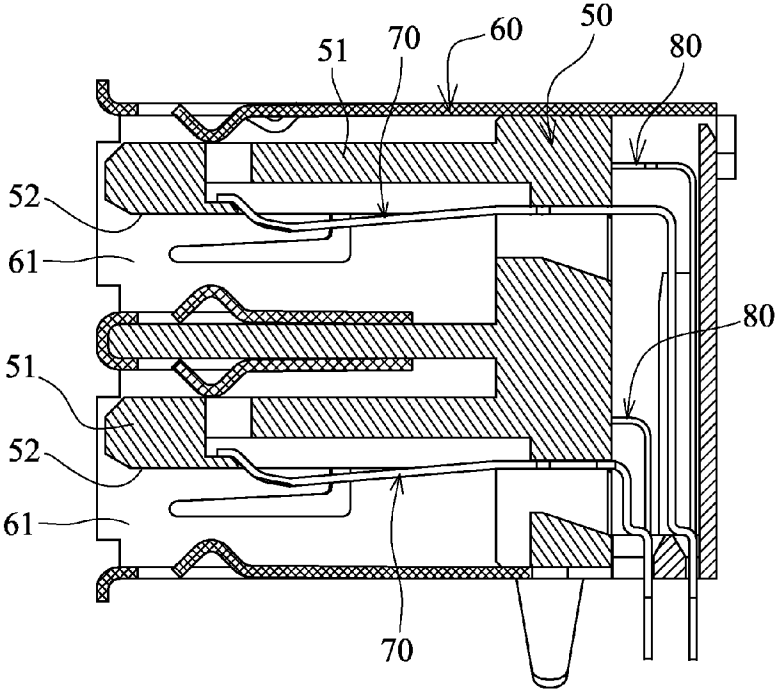
FIG. 44 is a cross-sectional side view showing an $18^{th}$ embodiment of the invention.

As shown in FIG. 44, the 18$^{th}$ embodiment of the invention is substantially the same as the twelfth embodiment except for the difference that this embodiment has the multilayer dual-connection slot design. That is, the plastic seat 50 has two tongues 51 disposed in conjunction with the metal casing 60 to form upper and lower connection slots 61 with the USB 3.0 interfaces.

Figure 45:
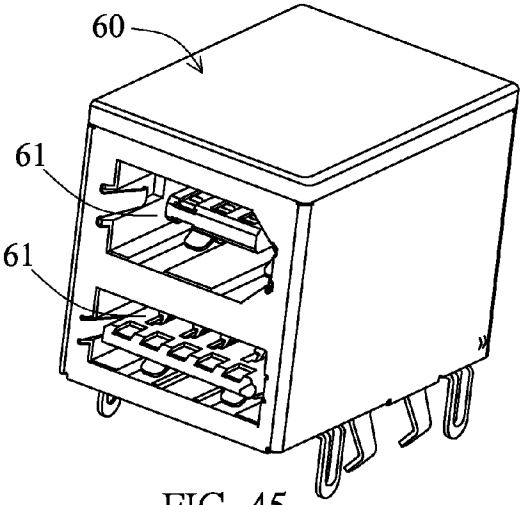
FIG. 45 is a pictorial view showing a $19^{th}$ embodiment of the invention.

As shown in FIG. 45, the 19$^{th}$ embodiment of the invention is substantially the same as the 18$^{th}$ embodiment except for the difference that the lower connection slot 61 of this embodiment has the USB 3.0 interface, and the upper connection slot 61 has the other interface.

Figure 46:
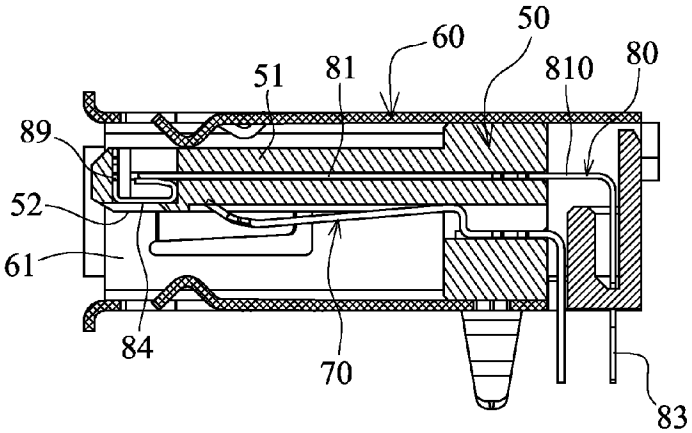
FIG. 46 is a cross-sectional side view showing a $20^{th}$ embodiment of the invention.

As shown in FIG. 46, the 20$^{th}$ embodiment of the invention is substantially the same as the twelfth embodiment except for the difference that the second terminal 80 of this embodiment has a two-part design. The second terminal 80 has a first member 89 and a second member 810, the first member 89 has the second contact 84, and the second member 810 has the extension 81 and the pin 83. The second member 810 is frontwardly assembled into the second terminal slot from the rear end of the plastic seat 50. The first member 89 is fixed to the front section of the tongue 51 and elastically rests against the extension 81 of the second member 810.

Figure 48:
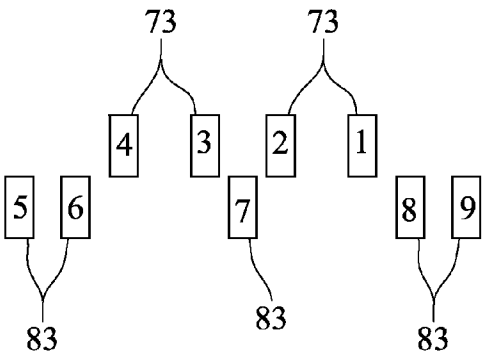
FIG. 48 is a schematic plane view showing positions of pins of the $21^{st}$ embodiment of the invention.
Figure 47:
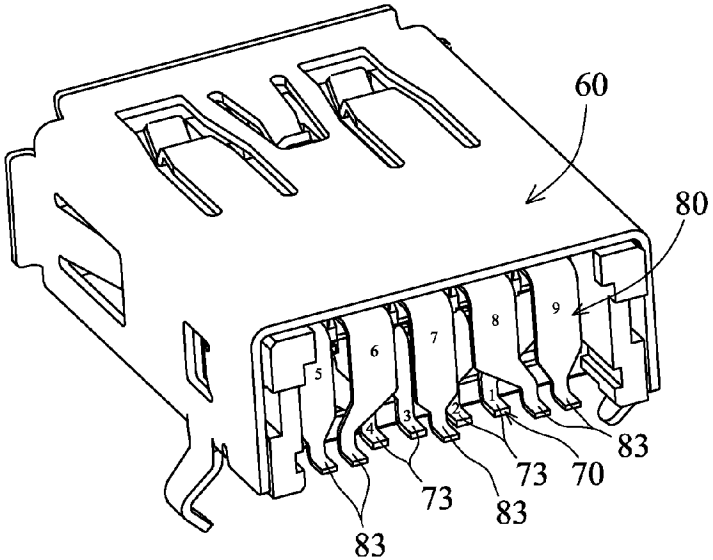
FIG. 47 is a pictorial view showing a $21^{st}$ embodiment of the invention.

As shown in FIGS. 47 and 48, the arrangement of pins of the 21$^{st}$ embodiment of the invention is substantially the same as that of the twelfth embodiment except for the difference that the pins 73 of the one row of first terminals 70 and the pins 83 of the one row of second terminals 80 in this embodiment are arranged in front and rear rows so as to prevent the mutual electrical interference. The arranged serial numbers 2 and 3 in the one row of first terminals 70 are one pair of signal terminals. The pins 73 of the one pair of signal terminals are separated from the pin 83 of the ground terminal 80 with the arranged serial number of 7 in the front-to-rear direction. So, the pins 73 of the one pair of signal terminals may be closer to each other, so that the signal transmission is better.

Figure 49:
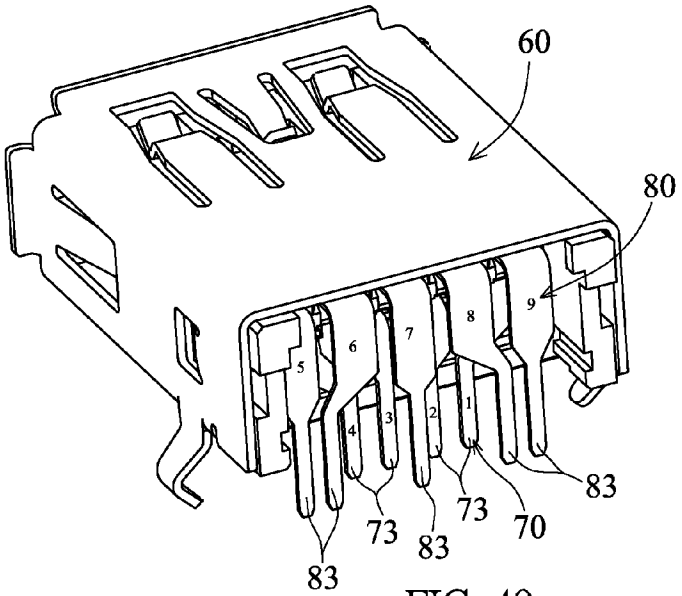
FIG. 49 is a pictorial view showing a $22^{nd}$ embodiment of the invention.

As shown in FIG. 49, the arrangement of pins of the 22$^{nd}$ embodiment of the invention is substantially the same as that of the 21$^{st}$ embodiment except for the difference that the pins 73 and 83 of the first and second terminals 70 and 80 of this embodiment are arranged longitudinally.

Figure 50:
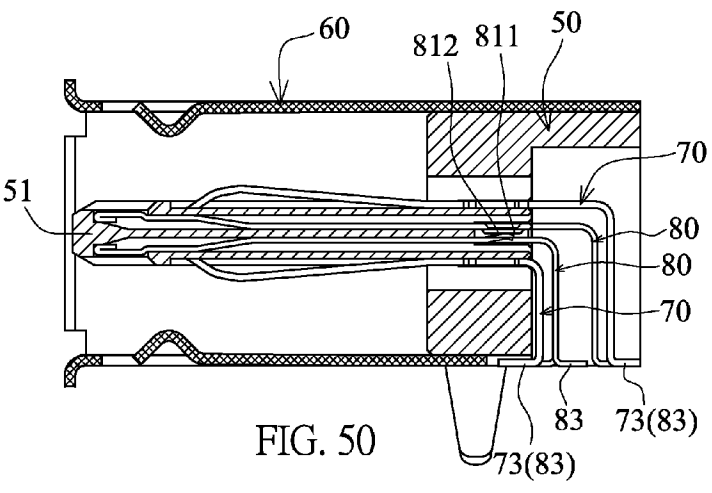
FIG. 50 is a cross-sectional side view showing a $23^{rd}$ embodiment of the invention.
Figure 51:
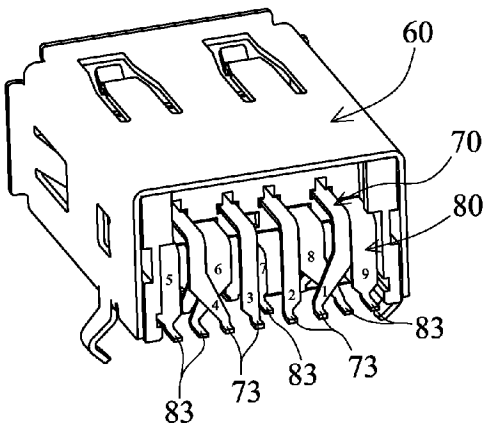
FIG. 51 is a pictorial view showing the $23^{rd}$ embodiment of the invention.

As shown in FIGS. 50 and 51, the arrangement of pins of the 23$^{rd}$ embodiment of the invention is substantially the same as that of the 16$^{th}$ embodiment except for the difference that the ground terminals with the arranged serial numbers of 7 in the two rows of second terminals 80 on the top and bottom surfaces of the tongue 51 of this embodiment share a pin 83. That is, the ground terminal on the top surface of the tongue has no pin but has a downward projection 811, and the ground terminal on the bottom surface of the tongue 51 has the pin 83 and an upward elastic sheet 812 contacting with the projection 811 of the ground terminal on the tongue. The pins 73 of the one row of first terminals 70 on the top surface of the tongue and the pins 83 (except for the ground terminal with the arranged serial number of 7) of the one row of second terminals 80 are horizontally arranged in one rear row extending backwards. The pins 73 of the one row of first terminals 70 and the pins 83 (except for the ground terminal with the arranged serial number of 7) of the one row of second terminals 80 on the bottom surface of the tongue are horizontally arranged in one front row extending frontwards. The shared pin 83 of the two ground terminals with the arranged serial number of 7 horizontally extends backwards and is disposed in the middle row. The arrangement of the front and rear rows of pins is the same as that of the thirteenth embodiment.

Figure 52:
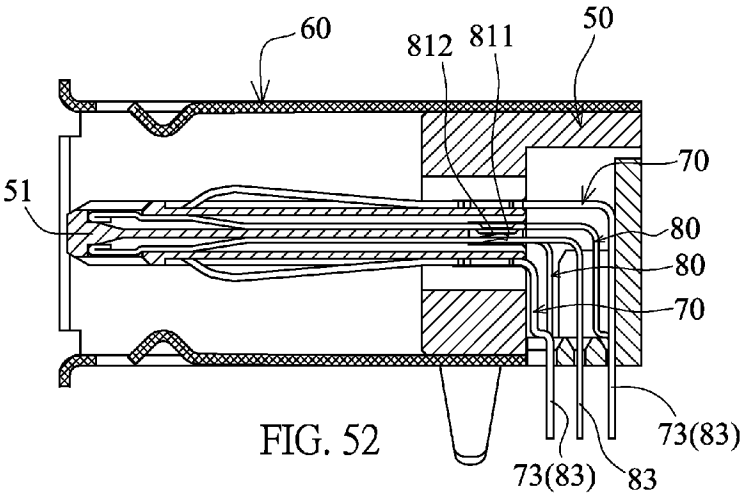
FIG. 52 is a cross-sectional side view showing a $24^{th}$ embodiment of the invention.
Figure 53:
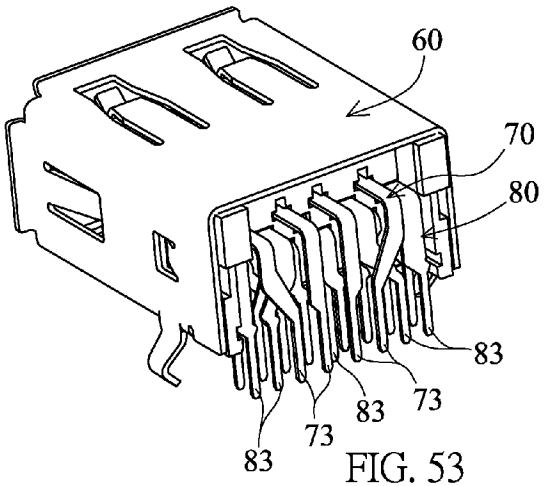
FIG. 53 is a pictorial view showing the $24^{th}$ embodiment of the invention.

As shown in FIGS. 52 and 53, the arrangement of pins of the 24$^{th}$ embodiment of the invention is substantially the same as that of the 23$^{rd}$ embodiment except for the difference that the pin of each terminal of this embodiment is longitudinal.

Figure 54:
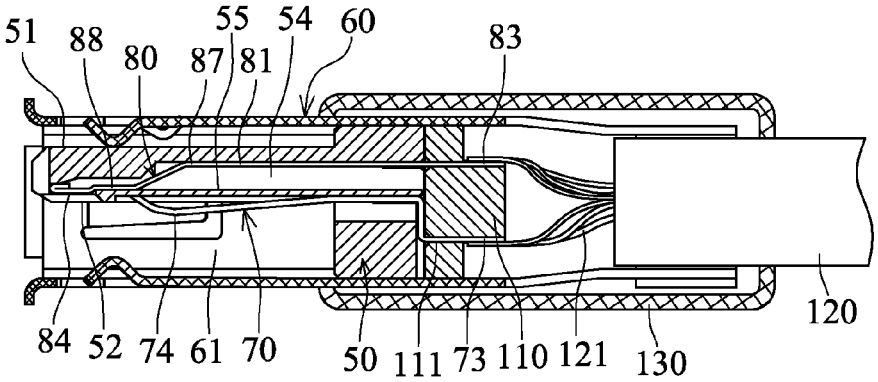
FIG. 54 is a cross-sectional side view showing a $25^{th}$ embodiment of the invention.

As shown in FIG. 54, the 25$^{th}$ embodiment of the invention is substantially the same as the twelfth embodiment except for the difference that this embodiment further has a rear plug 110, a conductive cable 120 and a plastic casing 130. The rear plug 110 is assembled with the rear end of the insulation base 50 and is tightly fit with the metal casing 60. The rear plug 110 has a wider front section and a narrower rear section and is in the form of T-shape when viewed from the lateral side. The rear plug 110 has two rows of through holes 111, through which the one row of first pins 73 and the one row of second pins 83 pass. The one row of first pins 73 are horizontally attached to the bottom surface of the rear section of the rear plug 110. The one row of second pins 83 are horizontally attached to the top surface of the rear section of the rear plug 110. Multiple wires 121 of the conductive cable 120 are electrically connected to the one row of first pins 73 and the one row of second pins 83. The rear section of the metal casing 60 extends by a length to cover the wires 121 and surrounds the conductive cable 120. The plastic casing 130 covers the rear section of the metal casing 60.

This embodiment provides the rear plug 110 assembled with the rear end of insulation base 50 and tightly fit with the metal casing 60. Thus, when the encapsulant is required, the glue cannot flow into the insulation base 50.

Figure 55:
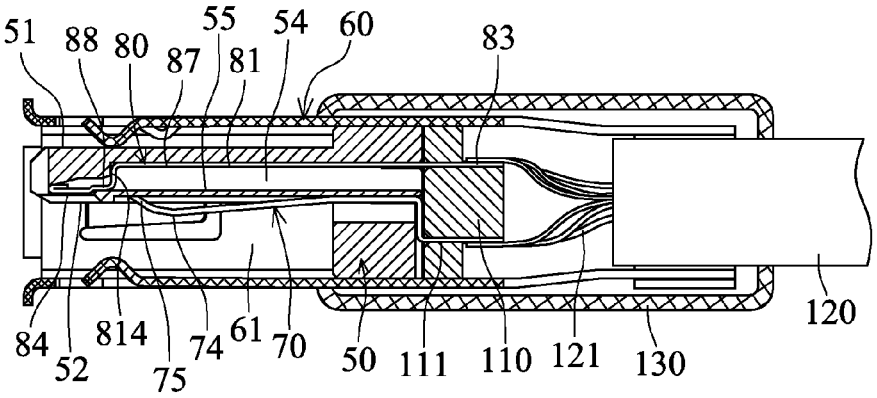
FIG. 55 is a cross-sectional side view showing a $26^{th}$ embodiment of the invention.

As shown in FIG. 55, the 26$^{th}$ embodiment of the invention is substantially the same as the 25$^{th}$ embodiment except for the difference that a vertical section 814 is formed between the first and second stages 87 and 88 of the extension 81 of the second terminal 80 in this embodiment. The second stage 88 rests against the resting surface 55 by a shorter length. However, the guide-in inclined surface 75 of the front end of the first terminal 70 cannot overlap with the second terminal 80 in the side-viewing direction. The first terminal 70 can be elastically moved vertically without touching the second terminal 80. So, the plate surface widths of the guide-in inclined surface 75 and the first contact 74 may also be the same.

Figure 56:
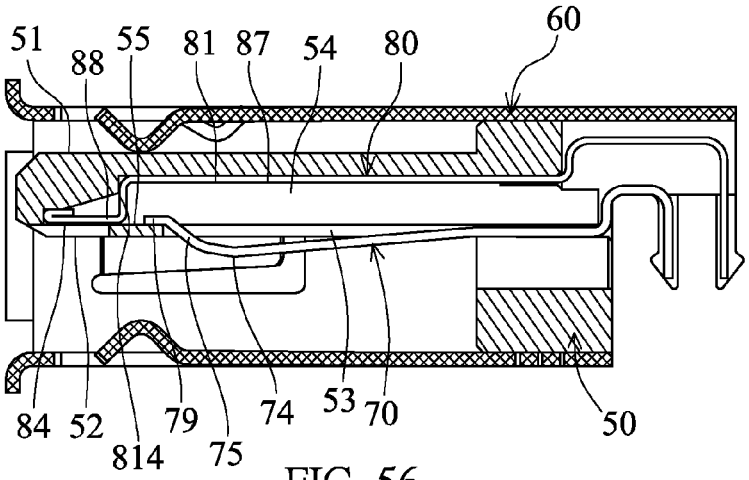
FIG. 56 is a cross-sectional side view showing a $27^{th}$ embodiment of the invention.

As shown in FIG. 56, the $27^{th}$ embodiment of the invention is substantially the same as the twelfth embodiment except for the difference that no separating baffle is provided at the overlapped portions between the one row of first terminal slots 53 and the one row of second terminal slots 54 in the top viewing direction in this embodiment, and a vertical section 814 is formed between the first and second stages 87 and 88 of the extension 81 of the second terminal 80. The second stage 88 rests against the resting surface 55 by a shorter length. However, the guide-in inclined surface 75 of the front end of the first terminal 70 cannot overlap with the second terminal 80 in the side-viewing direction. The first terminal 70 can be elastically moved vertically without touching the second terminal 80. So, plate surface widths of the guide-in inclined surface 75 and the first contact 74 may also be the same. In addition, the front end 79 of the first terminal 70 is in the over-pressure condition and rests against the resting surface 55.

Figures 57, 58, 59:
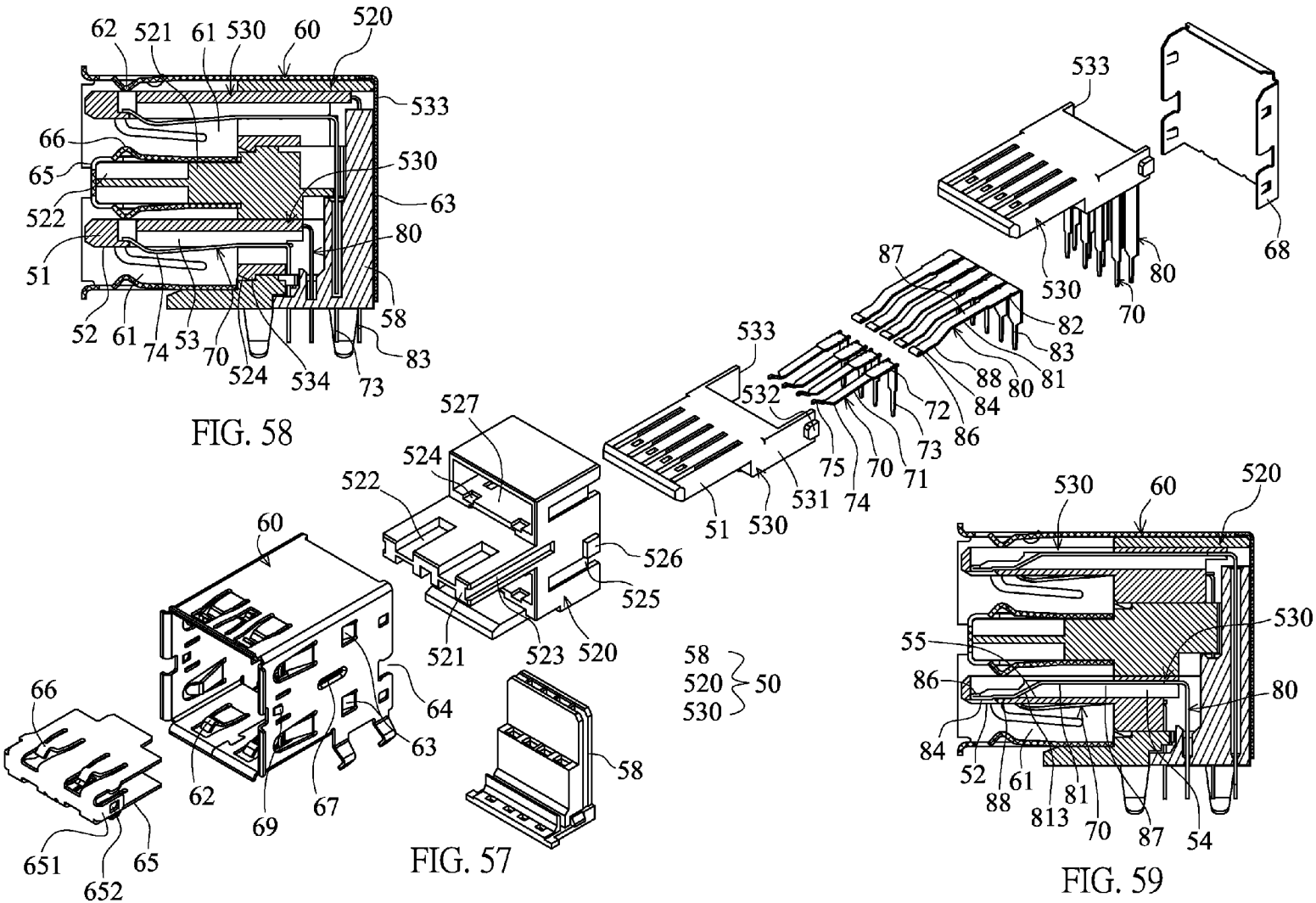
FIG. 57 is a pictorially exploded view showing a $28^{th}$ embodiment of the invention.
FIG. 58 is a cross-sectional side view showing the $28^{th}$ embodiment of the invention with the first terminal slot 53 being cut.
FIG. 59 is a cross-sectional side view showing the $28^{th}$ embodiment of the invention with the second terminal slot 54 being cut.

As shown in FIGS. 57 to 59, a dual-layer standard USB 3.0 socket according to the $28^{th}$ embodiment of the invention includes a plastic seat 50, a metal casing 60, a front covering member 65, two rows of first terminals 70 and two rows of second terminals 80.

The plastic seat 50 has a main frame 520, two tongue board members 530 and a rear cover 58. The main frame 520 has a divider 521 dividing the main frame 520 into upper and lower chambers 527. The front section of the divider 521 projects beyond the front end of the chamber 527, and each of the top and bottom surfaces of the divider 521 have two grooves 522. A groove 523 is formed on each of two side surfaces of the divider 521. Each of the two chambers 527 has two slots 524. Each of two sides of the main frame 520 has two slots 525 and an engaging block 526. Each of the tongue board members 530 is integrally formed with a tongue 51 and a mounting seat 531. The tongue 51 has a connection surface 52. Each of two side plates of the mounting seat 531 backwardly projects and has an engaging block 532. The mounting seat 531 of each of the tongue board members is assembled and fixed to one of the chambers 527. The bottom portion of the mounting seat 531 has two inverse hooks 534 hooking two slots 524 of the chamber 527 to prevent the backward movement. The engaging block 532 engaging with the slot 525 is stopped. The tongue 51 projects beyond the front end of the chamber 527. Similar to the plastic seat 50 of the twelfth embodiment, each of the tongue board members 530 is integrally formed with one row of first terminal slots 53 and one row of second terminal slots 54. The one row of first terminal slots 53 are closer to the connection surface 52 than the one row of second terminal slots 54. One surface of the second terminal slot 54 close to the connection surface is the resting surface 55. The detailed structures are completely the same as those of the twelfth embodiment, and detailed descriptions thereof will be omitted.

The metal casing 60 covers the plastic seat 50. The metal casing 60 and the front section of the divider 521 form two connection slots 61. The tongue 51 of each of the tongue board members 530 is disposed in the connection slot 61. A plug may be inserted into the connection slot 61. The connection surface 52 faces the insert-connection surface of the plug. At least one row of connection contacts are disposed on the insert-connection surface of the plug. The metal casing 60 has top, bottom, left and right surfaces. The metal casing 60 has an open front end and a rear end covered by a metal rear cover 68. The front end of the metal casing 60 has the insert ports of the two connection slots 61. Each of the top and bottom surfaces of the metal casing 60 is formed with two elastic locks 62 projecting inwards. Each of the two side surfaces of the metal casing 60 has two elastic inverse hooks 63 and one elastic inverse hook 69, and the rear end of the middle of the metal casing 60 has a notch 64. The middle of each of the two side surfaces of the metal casing 60 has an inwardly projecting projection 67. The elastic inverse hook 63 hooks the slot 525 to prevent the main frame 520 from moving backwards. The engaging block 526 engages with the notch 64 to stop the main frame 520 from moving forwards. The projections 67 engage with the groove 523 on the two side surfaces of the front section of the divider 521. The rear ends 533 of the two side plates of the two tongue board members 530 rest against the metal rear cover 68.

The structures of the two rows of first terminals 70 and the two rows of second terminals 80 are completely the same as those of the twelfth embodiment. The two rows of first terminals 70 are respectively assembled into the two rows of first terminal slots 53 of the two tongue board members 530. The two rows of second terminals 80 are respectively assembled into the two rows of second terminal slots 54 of the two tongue board members 530. The pins 73 of the two rows of first terminals 70 and the pins 83 of the two rows of second terminals 80 pass through the rear cover 58 for positioning.

The front covering member 65 is made of a metal material and has the U shape. Each of the top and bottom surfaces of the front covering member 65 has two outwardly projecting elastic locks 66. The front covering member 65 is fit with the front section of the divider 521 of the main frame 520. The elastic locks 66 on the top and bottom surfaces thereof project toward the two connection slots 61 and can be elastically moved in the grooves 522. In addition, each of two sides of the front end of the front covering member 65 has a side plate 651. Each of the two side plates 651 has an engaging hole 652. The two side plates 651 are fit with two sides of the metal casing 60. The elastic inverse hooks 69 on the two sides of the metal casing 60 hook the engaging holes 652 of the two side plates 651, so that the front covering member 65 cannot be ejected frontwards.

According to the above-mentioned structure, the multilayer USB 3.0 socket can be provided very simply.

In the above-mentioned multilayer design, the pins 73 of the one row of first terminals 70 and the pins of the one row of second terminals 80 disposed on the same tongue board member 530 may also be arranged horizontally in a manner similar to that of the thirteenth embodiment of FIG. 37.

In the above-mentioned multilayer design, the pins 73 of the one row of first terminals 70 and the pins of the one row of second terminals 80 disposed on the same tongue board member 530 may also be arranged in a manner similar to that of the $17^{th}$ embodiment of FIG. 43.

Figure 60:
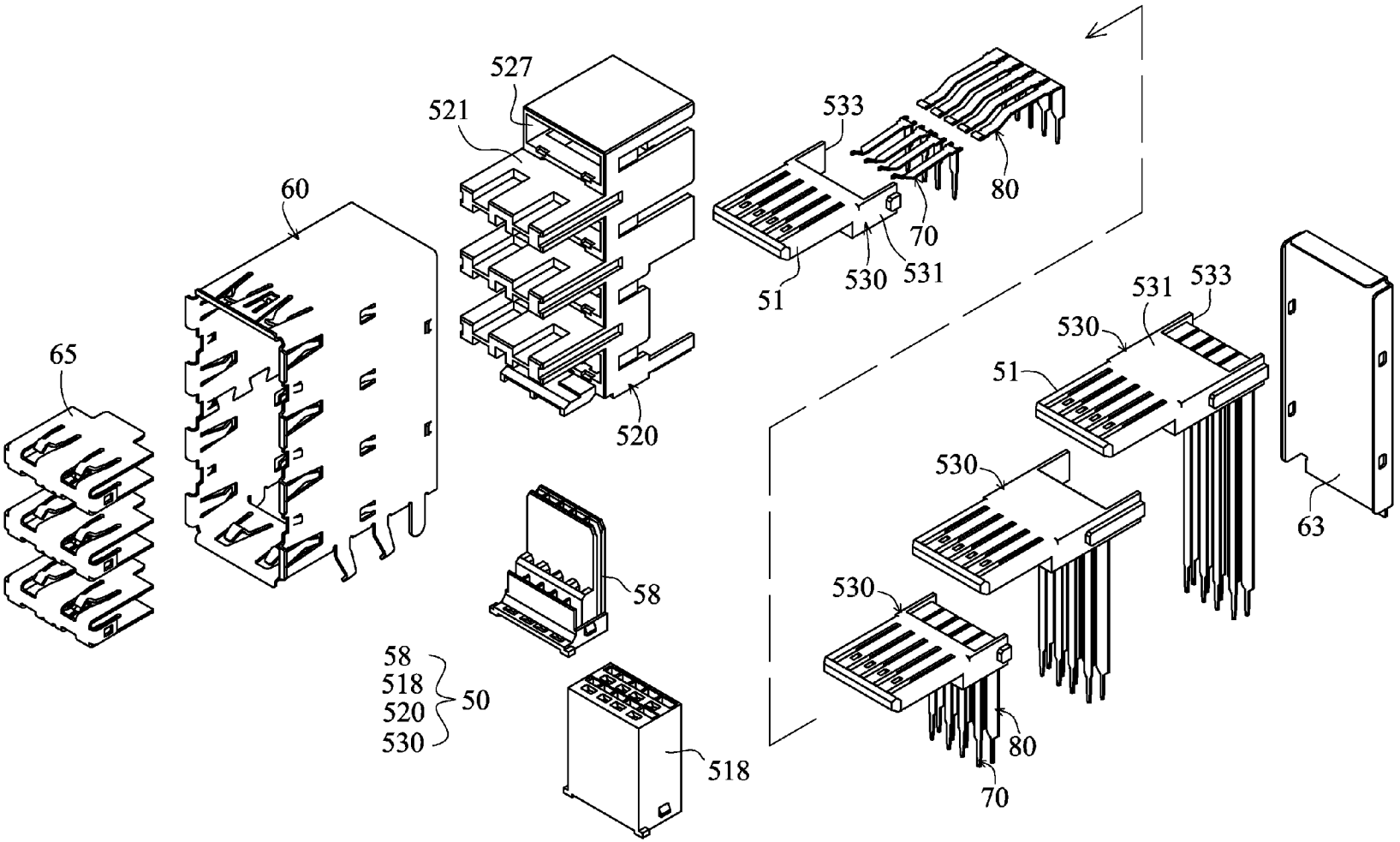
FIG. 60 is a pictorially exploded view showing a $29^{th}$ embodiment of the invention.
Figure 61:
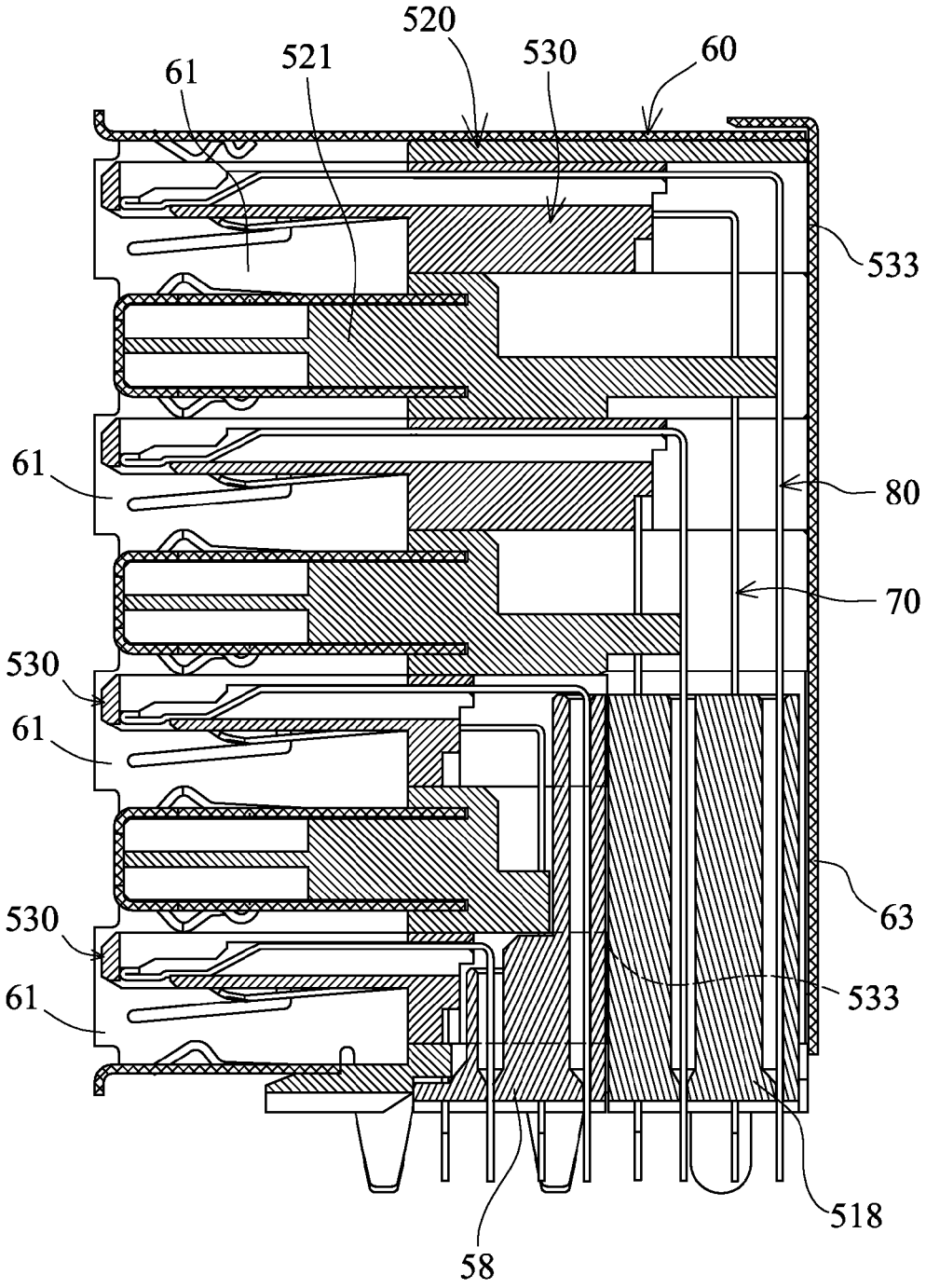
FIG. 61 is a cross-sectional side view showing the $29^{th}$ embodiment of the invention.

As shown in FIGS. 60 and 61, a four-layer standard USB 3.0 socket according to the $29^{th}$ embodiment of the invention is substantially the same as the $28^{th}$ embodiment except for the difference that the plastic seat 50 of this embodiment has a main frame 520, four tongue board members 530, a rear cover 58 and a second rear cover 518. The main frame 520 has three dividers 521 for dividing the main frame 520 into four chambers 527 stacked vertically. The metal casing 60 covers the plastic seat 50, and then the metal casing 60 and the front sections of the three dividers 521 form four connection slots 61. The pins of the two rows of first terminals 70 and the pins of the two rows of second terminals 80 on the lower two tongue board members 530 pass through the rear cover 58 for positioning. The pins of the two rows of first terminals 70 and the pins of the two rows of second terminals 80 on the upper two tongue board members 530 pass through the second rear cover 518 for positioning. The second rear cover 518 tightly rests between the rear cover 58 and the metal rear cover 68. The rear ends 533 of the two side plates of the lower two tongue board members 530 rest against the second rear cover 518. The rear ends 533 of the two side plates of the upper two tongue board members 530 directly rest against the metal rear cover 68.

Figure 63:
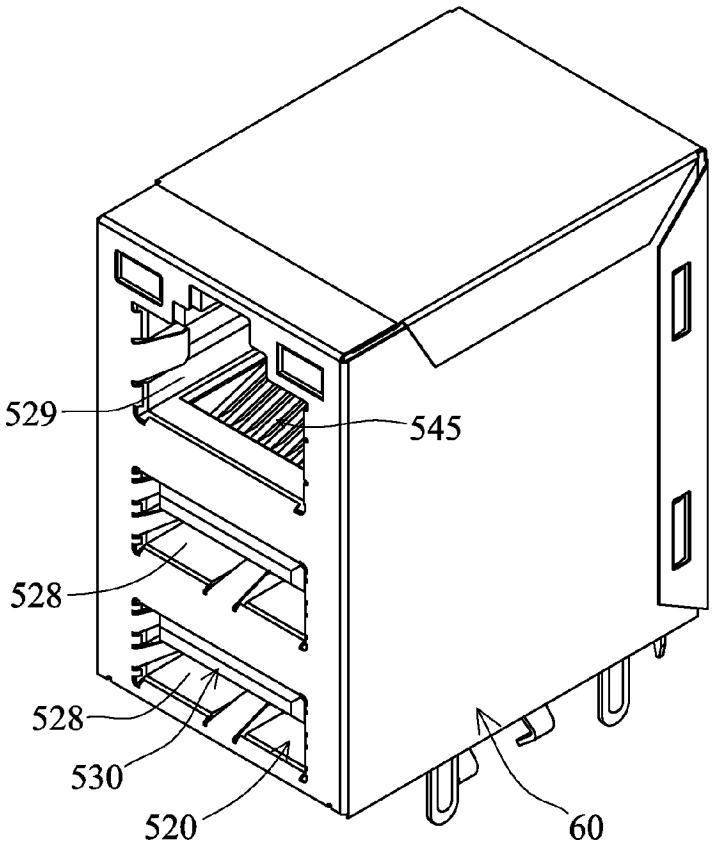
FIG. 63 is a pictorial view showing the $30^{th}$ embodiment of the invention.
Figure 62:
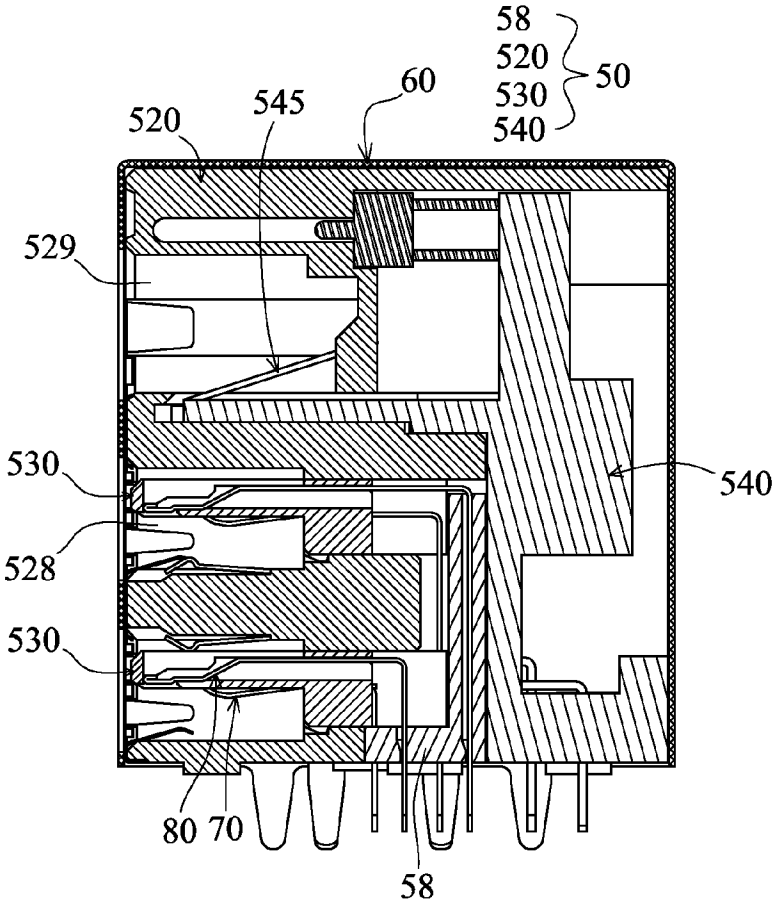
FIG. 62 is a cross-sectional side view showing a $30^{th}$ embodiment of the invention.

As shown in FIGS. 62 and 63, a combination of a dual-layer standard USB 3.0 socket and an RJ45 socket according to the 30$^{th}$ embodiment of the invention includes a plastic seat 50, a metal casing 60, two rows of first terminals 70, two rows of second terminals 80, and one row of RJ45 terminals 545, and is substantially the same as the 28$^{th}$ embodiment except for the difference that the plastic seat 50 of this embodiment is composed of a main frame 520, two tongue board members 530, a rear cover 58 and an RJ45 base 540 assembled together. Each of the two tongue board members 530 is assembled with one row of first terminals 70 and one row of second terminals 80. The one row of RJ45 terminals 545 are disposed on the RJ45 base 540. After the plastic seat 50 is assembled, the overall structure is formed with two USB connection slots 528 and one RJ45 connection slot 529, wherein the metal casing 60 only covers the plastic seat 50 and is not formed with the above-mentioned connection slot.

Figure 64:
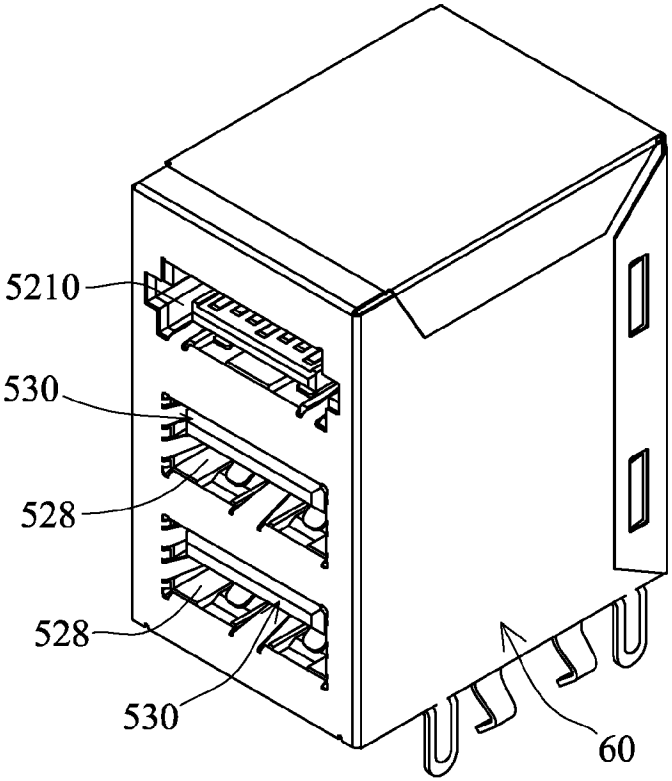
FIG. 64 is a cross-sectional side view showing a $31^{st}$ embodiment of the invention.

As shown in FIG. 64, a combination of a dual-layer standard USB 3.0 socket and an e-SATA+USB shared socket according to the 31$^{st}$ embodiment of the invention is substantially the same as the 30$^{th}$ embodiment except for the difference that the overall plastic seat 50 of this embodiment is formed with two USB connection slots 528 and an e-SATA+USB shared slot 5210.

Figure 65:
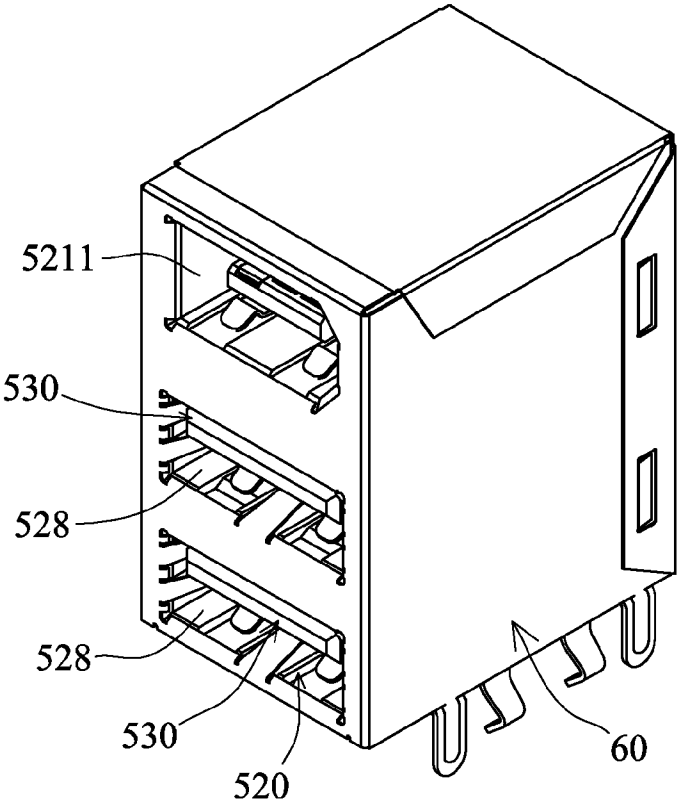
FIG. 65 is a cross-sectional side view showing a $32^{nd}$ embodiment of the invention.

As shown in FIG. 65, a combination of a dual-layer standard USB 3.0 socket and an IEEE 1394 socket according to the 32$^{nd}$ embodiment of the invention is substantially the same as the 30$^{th}$ embodiment except for the difference that the overall plastic seat 50 of this embodiment is formed with two USB connection slots 528 and one e-SATA+IEEE 1394 connection slot 5211.

Figure 66:
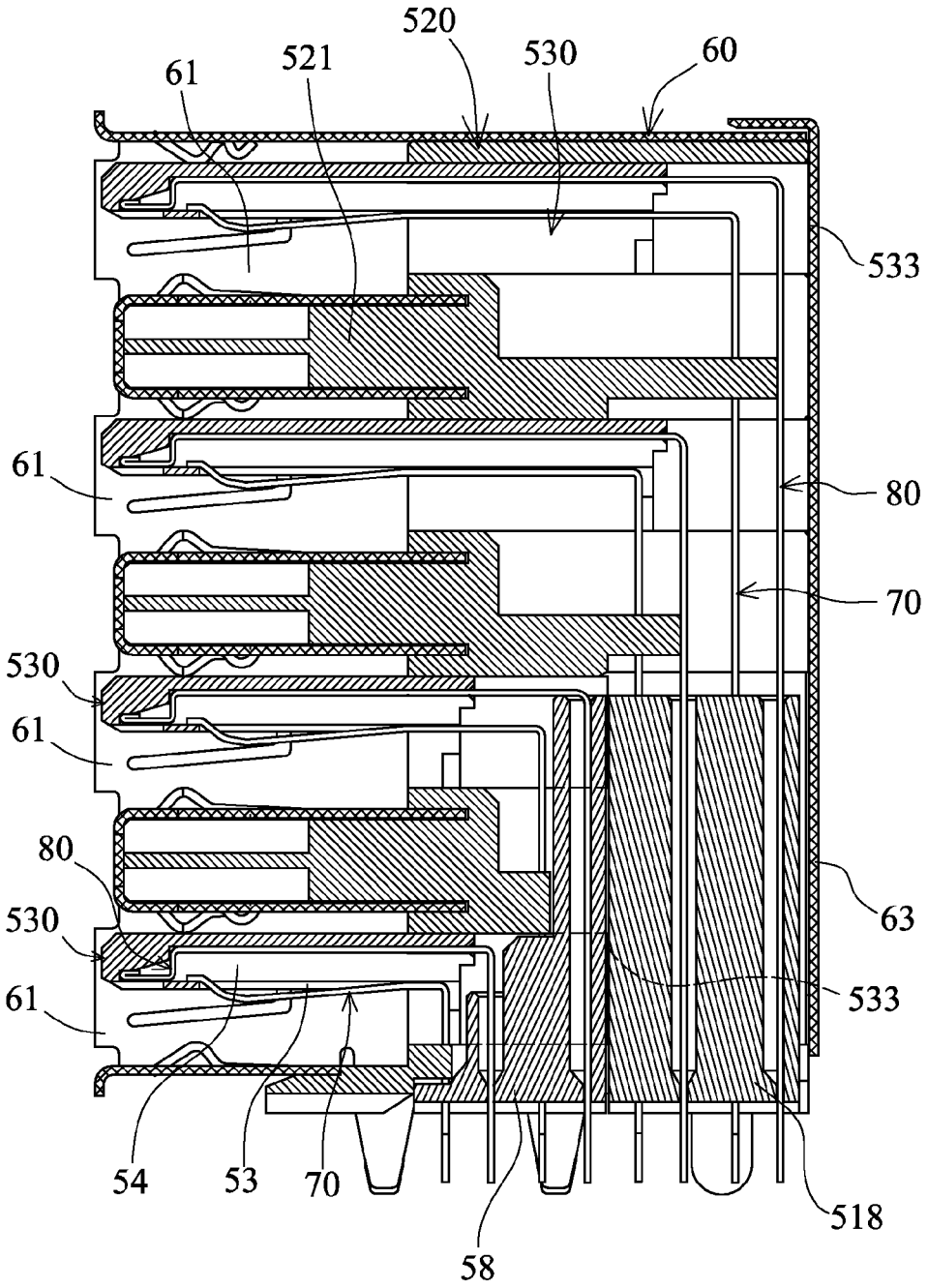
FIG. 66 is a cross-sectional side view showing a $33^{rd}$ embodiment of the invention.

As shown in FIG. 66, a four-layer standard USB 3.0 socket according to the 33$^{rd}$ embodiment of the invention is substantially the same as the 28$^{th}$ embodiment except for the difference that the structures of one row of first and second terminal slots 53 and 54 and the one row of first and second terminals 70 and 80 on each of the tongue board members 530 of this embodiment are the same as those of the 27$^{th}$ embodiment of FIG. 56.

Figure 67:
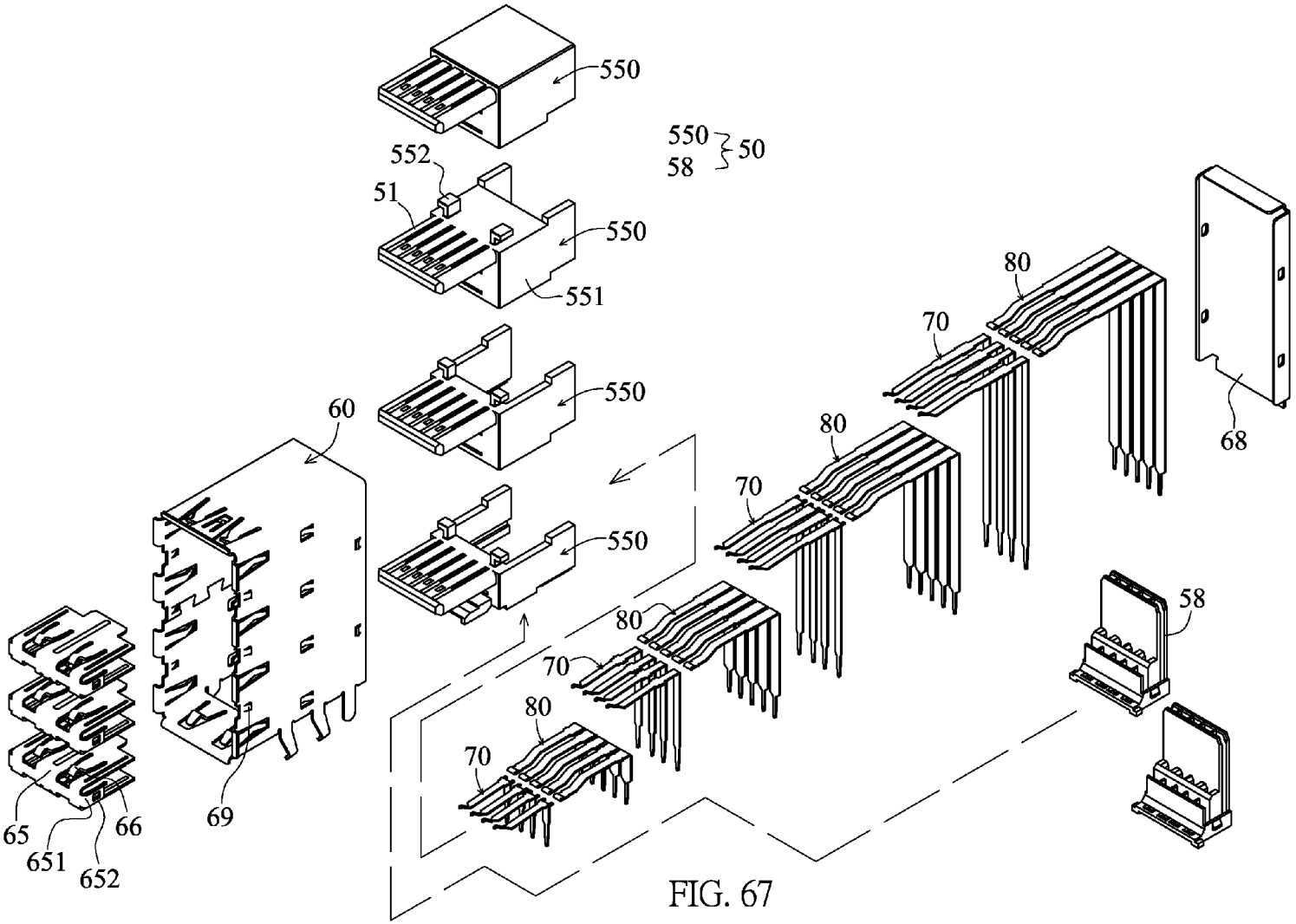
FIG. 67 is a pictorially exploded view showing a $34^{th}$ embodiment of the invention.
Figure 68:
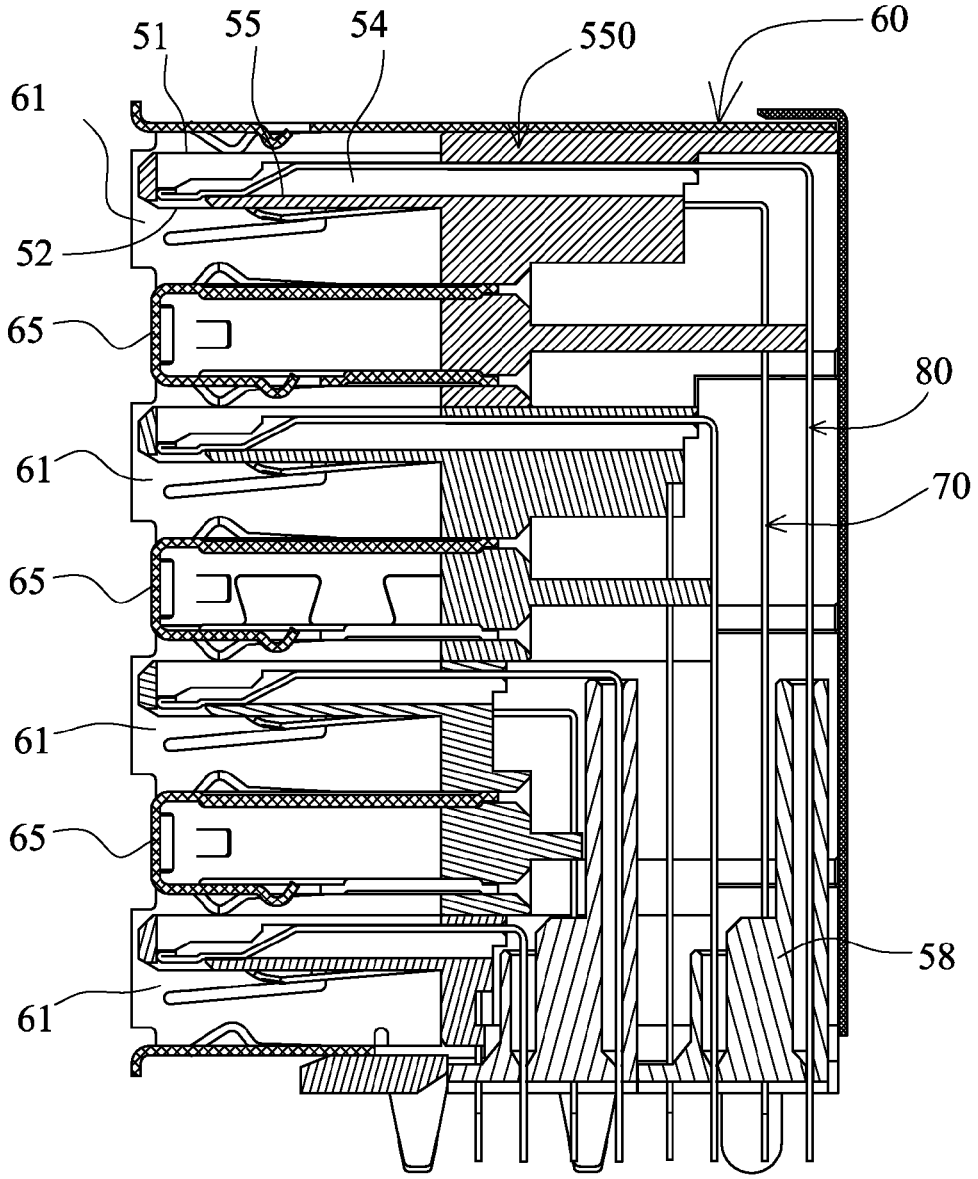
FIG. 68 is a cross-sectional side view showing a $34^{th}$ embodiment of the invention.

Referring to FIGS. 67 and 68, a four-layer standard USB 3.0 socket according to the 34$^{th}$ embodiment of the invention includes a plastic seat 50, a metal casing 60, three front covering members 65, four rows of first terminals 70 and four rows of second terminals 80, and is substantially the same as the twelfth, 28$^{th}$ and 29$^{th}$ embodiments except for the difference that the plastic seat 50 of this embodiment includes four unit seats 550 and two rear covers 58. Each unit seat 550 has a base 551 and a tongue 51. The base 551 is higher than the tongue 51. The tongue 51 projects beyond the front end of the base 551. Similar to the plastic seat 50 of the twelfth embodiment, each unit seat 550 is integrally formed with one row of first terminal slots and one row of second terminal slots 54. The one row of first terminal slots is closer to the connection surface 52 than the one row of second terminal slots 54. One surface of the second terminal slot 54 close to the connection surface is the resting surface 55. The detailed structures are completely the same as those of the twelfth embodiment, and detailed descriptions thereof will be omitted. The bases 551 of the four unit seats 550 can be vertically stacked and positioned. Top and bottom surfaces of the bases 551 of the two stacked unit seats 550 have hooks 552, which make the vertically stacked unit seats 550 be engaged with each other.

The front covering member 65 has the U-shaped cross section. The open ends of the three front covering members 65 are fixed to the bases 551 of three unit seats 550 in the front-to-rear direction. The structure of the front covering member 65 is the same as that of the 28$^{th}$ embodiment. Each of two sides of the metal casing 60 has an elastic inverse hook 69, and the hooks 69 similarly engage with the engagement holes 652 of the two side plates 651, so that the front covering member 65 cannot be ejected frontwards.

The three front covering members 65 and the metal casing 60 form four connection slots. Each tongue 51 is disposed in one connection slot 61. A plug may be inserted into each connection slot 61. The connection surface 52 and the insert-connection surface of the plug face each other. At least one row of connection contacts are disposed on the insert-connection surface of the plug.

While the present invention has been described by way of examples and in terms of preferred embodiments, it is to be understood that the present invention is not limited thereto. To the contrary, it is intended to cover various modifications. Therefore, the scope of the appended claims should be accorded the broadest interpretation so as to encompass all such modifications.

What is claimed is:

1. An electrical socket, comprising:

a plastic seat having a connection surface;

a connection slot disposed in the plastic seat, wherein the connection surface is disposed in the connection slot, a plug may be inserted into the connection slot, the connection surface faces an insert-connection surface of the plug, and at least one row of connection contacts are disposed on the insert-connection surface of the plug;

one row of first terminals disposed on the plastic seat, wherein the first terminal has an extension, a fixing portion and a pin, the extension is connected to a front end of the fixing portion, extends frontwards and has a first contact, the first contact can be elastically moved vertically and projects beyond the connection surface, and the pin is connected to a rear end of the fixing portion and extends out of the plastic seat; and one row of second terminals disposed on the plastic seat, wherein the second terminal has a second contact, an extension, a fixing portion and a pin, the extension is connected to a front end of the fixing portion and extends frontwards, the second contact is connected to a front end of the extension, the pin is connected to a rear end of the fixing portion and extends out of the plastic seat, and the second contact is disposed in front of the first contact, wherein:

the plastic seat has one row of first terminal slots and one row of second terminal slots, the one row of first terminal slots are closer to the connection surface than the one row of second terminal slots, one surface of the second terminal slot close to the connection surface is a resting surface, a front section of the second terminal slot has an opening communicating with the connection slot, the one row of first terminals are assembled into the one row of first terminal slots, the fixing portion of the first terminal is fixed to the first terminal slot, the one row of second terminals are assembled into the one row of second terminal slots, the fixing portion of the second terminal is fixed to the second terminal slot, a front section of the extension of the second terminal rests against the resting surface, and the second contact is exposed to the connection slot through the opening.

2. The electrical socket according to claim 1, wherein the plastic seat is integrally formed with the one row of first terminal slots and the one row of second terminal slots, or the plastic seat is integrally formed.

3. The electrical socket according to claim 1, wherein the extensions of the one row of first terminals at least partially overlap with the extensions of the one row of second terminals in a top viewing direction.

4. The electrical socket according to claim 3, further comprising baffles, which separate the one row of first terminal slots from the one row of second terminal slots and are disposed at overlapped portions in the top viewing direction.

5. The electrical socket according to claim 1, wherein a step is formed between the front section of the extension of the second terminal and the second contact in a side viewing direction, so that the second contact is closer to the connection surface than the resting surface, wherein the step is smaller than 0.15 mm, smaller than 0.2 mm, smaller than 0.3 mm or smaller than 0.5 mm.

6. The electrical socket according to claim 1, wherein the one row of first terminals contain four terminals, the one row of second terminals contain five terminals, the second contact is more depressed than the connection surface, the one row of first contacts and the one row of second contacts form an arrangement of a USB 3.0 interface.

7. The electrical socket according to claim 1, wherein the first terminal slot has a first slot, the second terminal slot has a second slot, the first slot is closer than the connection surface than the second slot, the fixing portion of the first terminal engages with the first slot, and the fixing portion of the second terminal engages with the second slot.

8. The electrical socket according to claim 5, wherein the extension of the second terminal and the second terminal slot form a gap extending in a vertical direction and being larger than the step, the fixing portion of the second terminal has a fitting portion tightly fitting with the second terminal slot.

9. The electrical socket according to claim 1, wherein a front end of the second terminal has a positioning portion resting against and positioning with a front section of the one surface of the second terminal slot opposite to the resting surface.

10. The electrical socket according to claim 1, wherein the connection slot is formed by a metal casing, the metal casing is positioned at a front end of the plastic seat, the front end of the plastic seat has a projecting tongue, and the connection surface is disposed on one surface of the tongue.

11. The electrical socket according to claim 1, wherein a front of the first contact of the first terminal has a guide-in inclined surface, the guide-in inclined surface is narrower than the first contact, the guide-in inclined surface of one of the one row of first terminals is disposed in a gap between two of the second terminals in a top viewing direction, and the guide-in inclined surface overlaps with the second terminal in a side viewing direction without touching the second terminal when the first contact elastically moves toward the connection surface.

12. The electrical socket according to claim 1, wherein the extension of the second terminal has, from rear to front, a horizontal first stage and a horizontal second stage, the second stage rests against the resting surface, and the first stage rests against one surface of the second terminal slot opposite to the resting surface.

13. The electrical socket according to claim 12, wherein an inclined section is formed between the first stage and the second stage, and an included angle between the inclined section and the first stage is greater than 110 degrees.

14. The electrical socket according to claim 10, wherein only one surface of the tongue has the connection surface, and the other surface of the tongue opposite to the connection surface has one row of open slots extending in a front-to-rear direction, so that the one row of second terminals are exposed from the open slots.

15. The electrical socket according to claim 9, wherein the front section of the one surface of the second terminal slot opposite to the resting surface has, from front to rear, a positioning surface and an inclined guiding surface connected together, the positioning surface of the one surface of the second terminal slot is a portion of the one surface of the second terminal slot, which is opposite to the resting surface and closest to the connection surface, and when the second terminal is assembled into the second terminal slot from rear to front, the positioning portion can be guided into and rest against the positioning surface for positioning along the inclined guiding surface.

16. The electrical socket according to claim 9, wherein the positioning portion of the second terminal has a reversely bent structure, such that the front end of the second terminal forms a circular arc surface.

17. The electrical socket according to claim 1, wherein a plate surface width from a rear end of the extension to the first contact of each of the one row of first terminals ranges from 0.8 mm to 1.2 mm, and a plate surface width from a rear end of the extension to the second contact of each of the one row of second terminals ranges from 0.8 mm to 1.4 mm.

18. The electrical socket according to claim 6, wherein the pins of the one row of first terminals and the pins of the one row of second terminals are arranged in one row or arranged in a front row and a rear row, respectively, the one row of second terminals sequentially include one pair of signal terminals, a ground terminal and the other pair of signal terminals arranged in a left-to-right direction, wherein pins of the one pair of signal terminals of the one row of second terminals are arranged on one side, pins of the other pair of signal terminals are arranged on the other side, a pin of the ground terminal is arranged at a middle, the pins of the sequential two terminals of the one row of first terminals are arranged between the pins of the one pair of signal terminals of the one row of second terminals and the pin of the ground terminal, the pins of the other sequential two terminals of the one row of first terminals are arranged between the ground terminal of the one row of second terminals and the pins of the other pair of signal terminals, and the pins of the one row of first and second terminals extend horizontally or longitudinally.

19. An electrical socket, comprising:

a plastic seat having a main frame and tongue board members, wherein at least one divider is disposed in the main frame to divide the plastic seat into vertically arranged chambers, each of the tongue board members has a tongue and a mounting seat, the tongue has a connection surface, and the mounting seat of each of the tongue board members is assembled and fixed to one of the chambers;

connection slots correspondingly disposed in front of the chambers of the plastic seat, wherein the tongue of each of the tongue board members is disposed in one of the connection slots, a plug may be inserted into each of the connection slots, insert-connection surfaces of the connection surface and the plug face each other, and at least one row of connection contacts are disposed on an insert-connection surface of the plug;

multiple rows of first terminals disposed on the tongue board members, respectively, wherein the first terminal has an extension, a fixing portion and a pin, the extension is connected to a front end of the fixing portion, extends frontwards and has a first contact, the first contact can be elastically moved vertically and projects beyond the connection surface, and the pin is connected to a rear end of the fixing portion and extends out of the plastic seat; and multiple rows of second terminals disposed on the tongue board members, respectively, wherein the second terminal has a second contact, an extension, a fixing portion and a pin, the extension is connected to a front end of the fixing portion and extends frontwards, the second contact is connected to a front end of the extension, the pin is connected to a rear end of the fixing portion and extends out of the plastic seat, and the second contact is disposed in front of the first contact;

wherein the tongue board member is integrally formed with one row of first terminal slots and one row of second terminal slots, the one row of first terminal slots are closer to the connection surface than the one row of second terminal slots, one surface of the second terminal slot close to the connection surface is a resting surface, a front section of the second terminal slot is formed with an opening communicating with the connection slot, one of the rows of first terminals are assembled into the one row of first terminal slots, the fixing portion of the first terminal is fixed to the first terminal slot, one of the rows of second terminals are assembled into the one row of second terminal slots, the fixing portion of the second terminal is fixed to the second terminal slot, a front section of the extension of the second terminal rests against the resting surface, and the second contact is exposed to the connection slot through the opening.

20. The electrical socket according to claim 19, further comprising a metal casing covering the plastic seat, wherein a front section of the divider and each of the tongues project beyond a front end of the chamber, and the metal casing and the front section of the at least one divider form the connection slots.

21. The electrical socket according to claim 19, wherein a bottom surface of one of the chambers of the main frame has a slot, and a bottom portion of the mounting seat has an inverse hook hooking the slot of the chamber to prevent backward movement.

22. The electrical socket according to claim 19, wherein the extensions of the one row of first terminals of the tongue board member at least partially overlap with the one row of second terminals in a top viewing direction, and the electrical socket further comprises baffles, which separate the one row of first terminal slots from the one row of second terminal slots and are disposed at overlapped portions in the top viewing direction.

23. The electrical socket according to claim 19, wherein a step is formed between the front section of the extension of the second terminal and the second contact in a side viewing direction, so that the second contact is closer to the connection surface than the resting surface, wherein the step is smaller than 0.15 mm, smaller than 0.2 mm, smaller than 0.3 mm or smaller than 0.5 mm.

24. An electrical socket, comprising:

a plastic seat having multiple unit seats, wherein each of the unit seats has a base and a tongue, the base is higher than the tongue, the tongue projects beyond a front end of the base and has a connection surface, and the bases of the unit seats can be vertically stacked and positioned;

multiple rows of first terminals respectively disposed on the unit seats, wherein the first terminal has an extension, a fixing portion and a pin, the extension is connected to a front end of the fixing portion, extends frontwards and has a first contact, the first contact can be elastically moved vertically and projects beyond the connection surface, and the pin is connected to a rear end of the fixing portion and extends out of the unit seat;

multiple rows of second terminals respectively disposed on the unit seats, wherein the second terminal has a second contact, an extension, a fixing portion and a pin, the extension is connected to a front end of the fixing portion and extends frontwards, the second contact is connected to a front end of the extension, the pin is connected to a rear end of the fixing portion and extends out of the unit seat, and the second contact is disposed in front of the first contact;

a metal casing covering the plastic seat; and at least one front covering member having a U-shaped cross section, wherein an open end of the at least one front covering member is fixed to the base of one of the unit seats in a front-to-rear direction, the at least one front covering member and the metal casing form multiple connection slots, each of the tongues is disposed in one of the connection slots, a plug may be inserted into each of the connection slots, the connection surface and an insert-connection surface of the plug face each other, and at least one row of connection contacts are disposed on the insert-connection surface of the plug, wherein each of the unit seats is integrally formed with one row of first terminal slots and one row of second terminal slots, the one row of first terminal slots are closer to the connection surface than the one row of second terminal slots, one surface of the second terminal slot close to the connection surface is a resting surface, a front section of the second terminal slot has an opening communicating with the connection slot, one row of first terminals are assembled into the one row of first terminal slots, the fixing portion of the first terminal is fixed to the first terminal slot, one row of the multiple rows of second terminals are assembled into the one row of second terminal slots, the fixing portion of the second terminal is fixed to the second terminal slot, a front section of the extension of the second terminal rests against the resting surface, and the second contact is exposed to the connection slot through the opening.

25. The electrical socket according to claim 24, wherein each of top and bottom surfaces of the front covering member has two outwardly projecting elastic locks, each of two sides of a front end of the front covering member has a side plate, each of the two side plates has an engagement hole, the two side plates are fit with two sides of the metal casing, each of the two sides of the metal casing has an elastic inverse hook, and the elastic inverse hooks hook the engagement holes of the two side plates so that the front covering member cannot be ejected frontwards.

* * * * *